US007641596B2

(12) United States Patent
Sharps

(10) Patent No.: US 7,641,596 B2
(45) **Date of Patent: *Jan. 5, 2010**

(54) GOLF SWING SIMULATOR AND EXERCISE DEVICE

(76) Inventor: Chester H. Sharps, 3 Broad Run Rd., Manakin-Sabot, VA (US) 23103

( * ) Notice: Subject to any disclaimer, the term of this patent is extended or adjusted under 35 U.S.C. 154(b) by 247 days.

This patent is subject to a terminal disclaimer.

(21) Appl. No.: 11/592,559

(22) Filed: Nov. 3, 2006

(65) Prior Publication Data

US 2007/0093363 A1 Apr. 26, 2007

Related U.S. Application Data

(63) Continuation-in-part of application No. 11/195,153, filed on Aug. 2, 2005, which is a continuation-in-part of application No. 10/669,922, filed on Sep. 24, 2003, now Pat. No. 7,121,987.

(60) Provisional application No. 60/413,191, filed on Sep. 24, 2002.

(51) Int. Cl.
*A63B 69/36* (2006.01)
*A63B 23/02* (2006.01)

(52) U.S. Cl. ..... 482/51; 473/276; 482/92; 482/136

(58) Field of Classification Search ..... 482/51, 482/69, 78, 127, 136–138, 140, 143; 434/252; 473/212, 266, 276
See application file for complete search history.

(56) References Cited

U.S. PATENT DOCUMENTS

| | | | | |
|---|---|---|---|---|
| 2,472,065 | A * | 6/1949 | Frank | 473/229 |
| 2,737,432 | A * | 3/1956 | Troutman | 346/44 |
| 2,921,791 | A * | 1/1960 | Berne | 482/118 |
| 3,138,388 | A * | 6/1964 | Herold | 473/276 |
| 3,319,963 | A * | 5/1967 | Cockburn | 473/229 |
| 3,595,583 | A * | 7/1971 | Oppenheimer | 473/215 |
| 3,926,430 | A | 12/1975 | Good, Jr. | |
| 4,758,000 | A * | 7/1988 | Cox | 473/208 |

(Continued)

FOREIGN PATENT DOCUMENTS

EP 03756858.1 11/2008

(Continued)

*Primary Examiner*—Loan H Thanh
*Assistant Examiner*—Victor K Hwang
(74) *Attorney, Agent, or Firm*—Hunton & Williams LLP

(57) ABSTRACT

In an illustrative embodiment of the invention, an exercise device comprises a support structure comprising a support member and a support arm having an upper support arm portion and a lower support arm portion. The support arm is mounted to the support member by a pivot assembly comprising a longitudinal pivot control mechanism and a lateral pivot control mechanism. The longitudinal pivot control mechanism is configured to allow the support arm to be selectively positioned at a first angular orientation in a longitudinal plane and the lateral pivot control mechanism is configured to allow the support arm to be selectively positioned at a second angular orientation in a lateral plane orthogonal to the longitudinal plane. The exercise device further comprises a yoke pivotably attached to the upper support arm by a yoke attachment member for rotation about a yoke rotation axis. The yoke is configured for engagement by a user in an exercise orientation and for selective rotation about the yoke rotation axis by the user.

17 Claims, 28 Drawing Sheets

U.S. PATENT DOCUMENTS

| | | | | |
|---|---|---|---|---|
| 5,039,091 | A | 8/1991 | Johnson | |
| 5,050,871 | A | 9/1991 | Douglas et al. | |
| 5,125,882 | A | 6/1992 | La Mothe et al. | |
| 5,301,948 | A * | 4/1994 | Hundley | 473/229 |
| 5,454,773 | A * | 10/1995 | Blanchard et al. | 482/133 |
| 5,755,646 | A * | 5/1998 | Chu | 482/118 |
| 6,056,676 | A * | 5/2000 | Adams | 482/112 |
| 6,174,270 | B1 | 1/2001 | Dagenais | |
| 6,371,863 | B1 * | 4/2002 | Moran | 473/207 |
| 7,150,682 | B2 | 12/2006 | Varner | |
| 2005/0014571 | A1 | 1/2005 | Varner | |
| 2005/0187076 | A1 * | 8/2005 | Mason | 482/93 |
| 2006/0003875 | A1 * | 1/2006 | Sharps | 482/100 |
| 2007/0037663 | A1 * | 2/2007 | Goel et al. | 482/1 |

FOREIGN PATENT DOCUMENTS

| | | | |
|---|---|---|---|
| WO | WO 8801526 | A1 * | 3/1988 |
| WO | PCT/US07/82073 | | 6/2008 |

* cited by examiner

GOLF SWING SIMULATOR AND EXERCISE DEVICE

This application is a continuation-in-part of U.S. application Ser. No. 11/195,153, filed Aug. 2, 2005, which is a continuation-in-part of U.S. application Ser. No. 10/669,922, now U.S. Pat. No. 7,121,987, filed Sep. 24, 2003, which claims priority to U.S. Provisional Application No. 60/413,191, filed Sep. 24, 2002, all of which are incorporated herein by reference in their entirety.

BACKGROUND OF THE INVENTION

The invention is directed to a golf exercise device, and, more particularly, to a golf exercise device that is adjustable to accommodate various-sized users and is designed to mimic and improve the golf swing by aerobically and/or anaerobically strengthening the large rotary muscles of the body—including the upper thigh, trunk and abdomen, and shoulders—most used in performing a golf swing, and to train the swing in the proper muscle usage.

Conventional exercises and exercise machines, such as Nautilus or other weight or resistance-type systems, are frequently used to strengthen muscles of the body. For example, the abdominal muscles are strengthened through sit ups or specialty abdominal strengtheners. Also, muscles of the chest and shoulders are strengthened through a variety of chest and shoulder press machines. Likewise, leg press machines can be used to strengthen the thigh muscles. These types of machines are readily available at gymnasiums, and in the home. However effective these machines may be at offering weight-resistant strength training, the muscles are not trained or strengthened in a manner that is analogous to the golf swing.

There are other specialty devices geared towards improving the golf swing. Such devices include weighted golf clubs or a golf club device with a fan or some other form of air resistance. Nevertheless, such devices provide only limited resistance and predominantly strengthen the hands and forearms; they do not have the isotonic strengthening benefits of a machine that turns with the large rotary muscles that are so important to a proper golf swing.

Therefore, there remains a need for a device that can simultaneously guide a user through the proper golf swing and strengthen the large rotary muscles used during the performance of a proper golf swing.

SUMMARY OF THE INVENTION

It is an object of the present invention to provide a device that can guide a user through a proper golf swing, and to train the user in that proper golf swing.

It is another object of the present invention to provide a device in which the trajectory and movement of a user's body during a proper golf swing are encouraged through progressive resistance training of the muscles used during a proper golf swing.

It is another object of the present invention to provide a device for aerobically and/or anaerobically strengthening the large rotary muscles of the body, including the upper thigh, trunk and abdomen, and shoulders, most used in performing a golf swing.

It is another object of the present invention to provide a device that not only can be oriented and adjusted to mimic the position of a user's body during a "proper" golf swing, but that can be adjusted to fit the position and dimensions of other user's bodies as well.

It is another object of the present invention to provide a device that offers multiple degrees of freedom of adjustment.

It is another object of the present invention to provide a device that can offer variable resistance to the user during the simulated golf swing.

It is another object of the present invention to guide the user into proper swing mechanics due to the large muscle forces needed to turn the device against variable weight resistance.

In an illustrative embodiment of the invention, an exercise device comprises a support structure comprising a support member and a support arm having an upper support arm portion and a lower support arm portion. The support arm is mounted to the support member by a pivot assembly comprising a longitudinal pivot control mechanism and a lateral pivot control mechanism. The longitudinal pivot control mechanism is configured to allow the support arm to be selectively positioned at a first angular orientation in a longitudinal plane and the lateral pivot control mechanism is configured to allow the support arm to be selectively positioned at a second angular orientation in a lateral plane orthogonal to the longitudinal plane. The exercise device further comprises a yoke pivotably attached to the upper support arm by a yoke attachment member for rotation about a yoke rotation axis. The yoke is configured for engagement by a user in an exercise orientation and for selective rotation about the yoke rotation axis by the user.

Further objects, features and advantages of the invention will be apparent from the detailed description below taken in conjunction with the accompanying drawings.

BRIEF DESCRIPTION OF THE DRAWINGS

The present invention can be more fully understood by reading the following detailed description of the embodiments together with the accompanying drawings, in which like reference indicators are used to designate like elements, and in which.

DETAILED DESCRIPTION OF THE INVENTION

Operation of embodiments of the present invention will now be described. Any specific dimensions, angular orientations or configurations depicted in the figures are for representation of the exemplary embodiments herein and should not be interpreted as limiting or restrictive to the scope of the invention.

Figure 1:
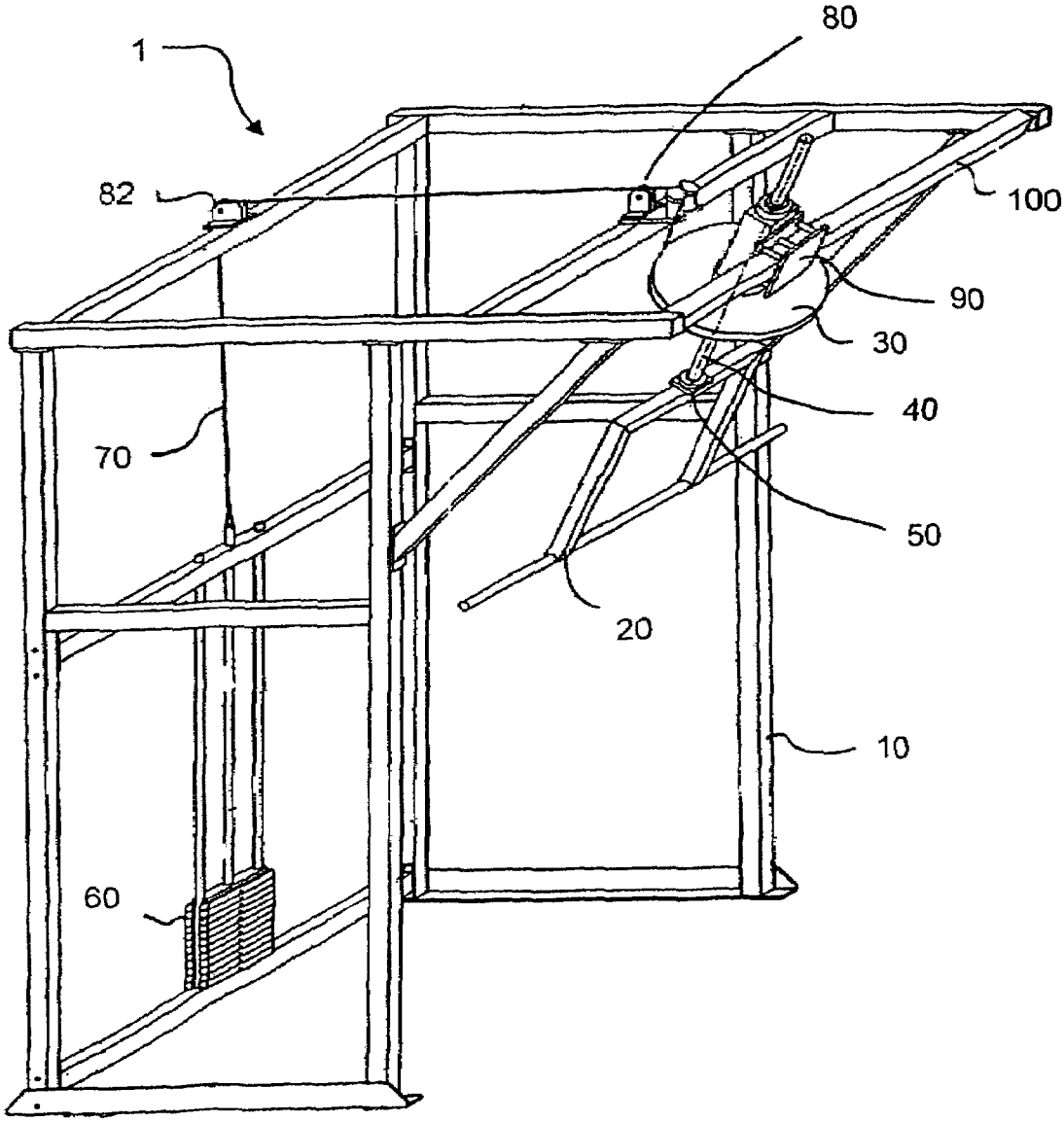
FIG. 1 depicts a left perspective view of a golf exercise device, configured for a right-hand swing, in accordance with an embodiment of the present invention.

As shown in FIG. 1, a golf exercise device 1 according to an embodiment of the invention includes a frame 10 that supports a yoke 20. Yoke 20 is rotatably connected to the frame 10 through a flywheel 30 and support arm 40. Preferably, the yoke 20 has a center of rotation that is aligned with the ideal position of the golfer's spine during a golf swing and there is a 360-degree rotational joint 50 at the base of the support arm 40.

As the golfer's body twists about this center of rotation, that is, as the golfer performs a simulated golf swing and accordingly twists his/her body around a "fixed spine," the yoke 20 twists and turns the rotational joint 50, which turns the support arm 40, which turns the flywheel 30, which lifts a resistance 60 that is connected to the flywheel 30 through a cable 70, a first pulley 80, and a second pulley 82. In this embodiment, resistance 60 is comprised of a weight stack. By varying the amount of weight on resistance 60, the difficulty of the twisting motion can be varied to provide gradually increasing (or decreasing) resistance and strength training.

Figure 5:
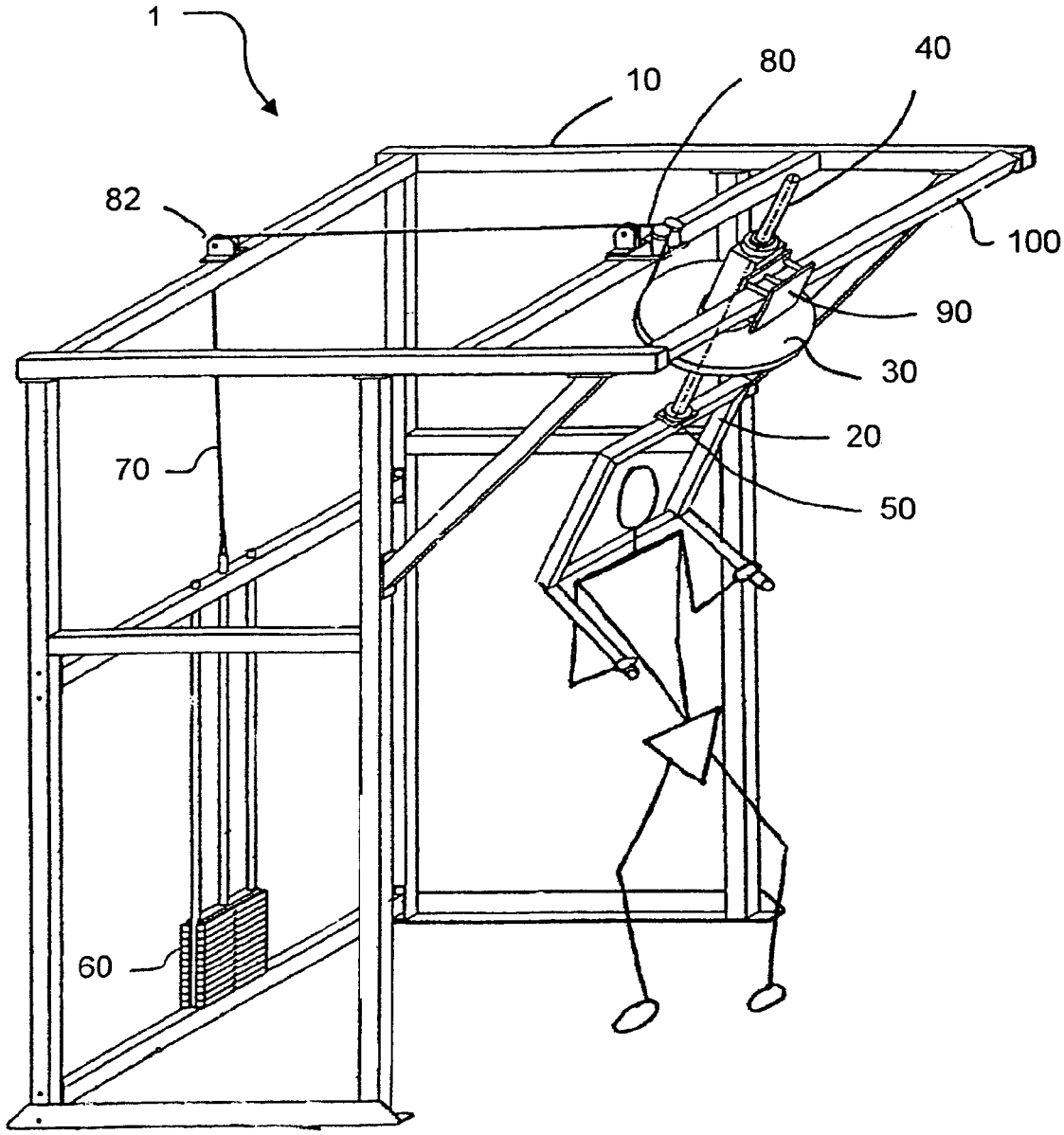
FIG. 5 depicts a left perspective view of a golf exercise device, configured for a right-hand swing with the yoke in a hands-forward position, depicting a user inside the frame in accordance with an embodiment of the present invention.
Figure 6:
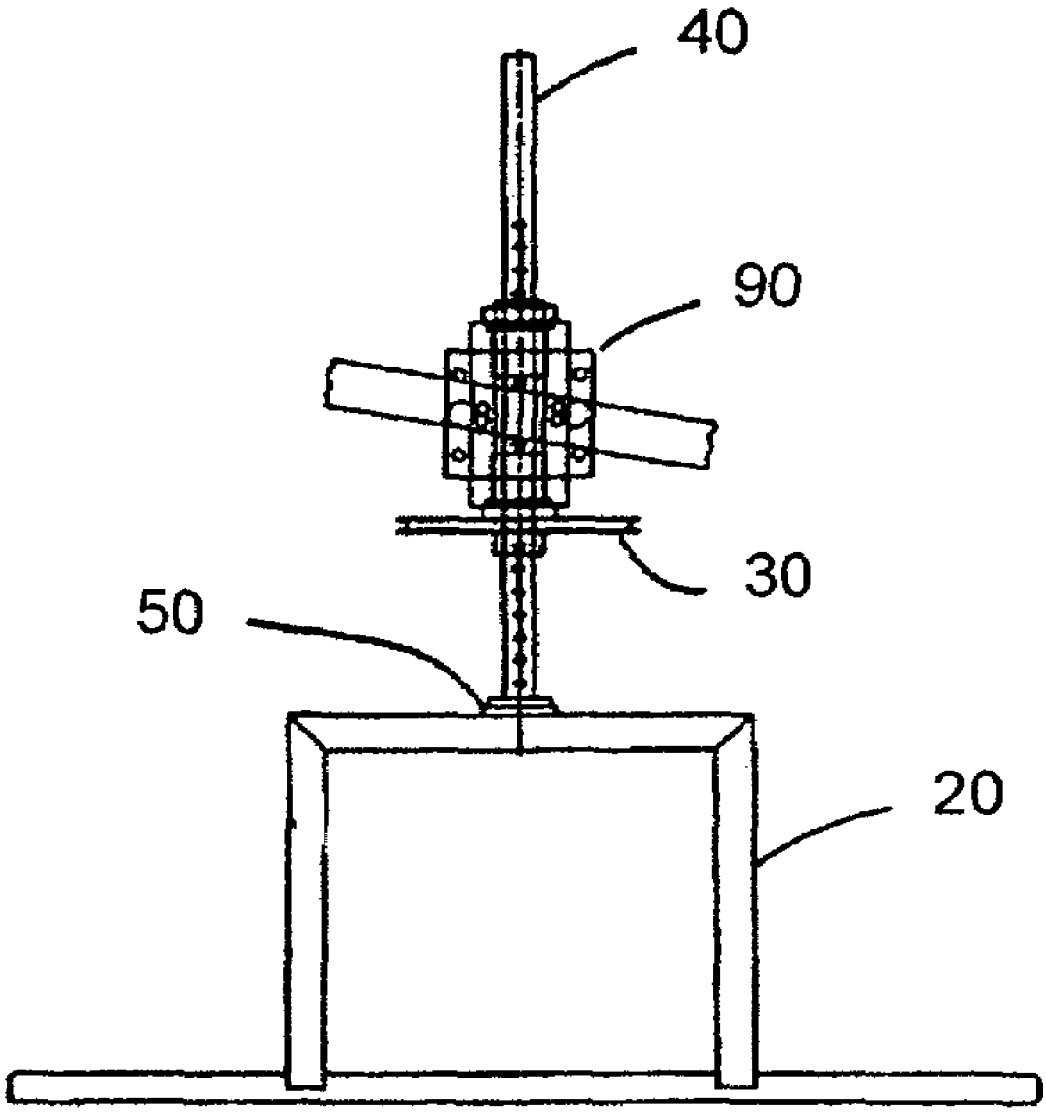
FIG. 6 depicts a front view of the flywheel-yoke-support arm component subassembly in accordance with an embodiment of the present invention.
Figure 7:
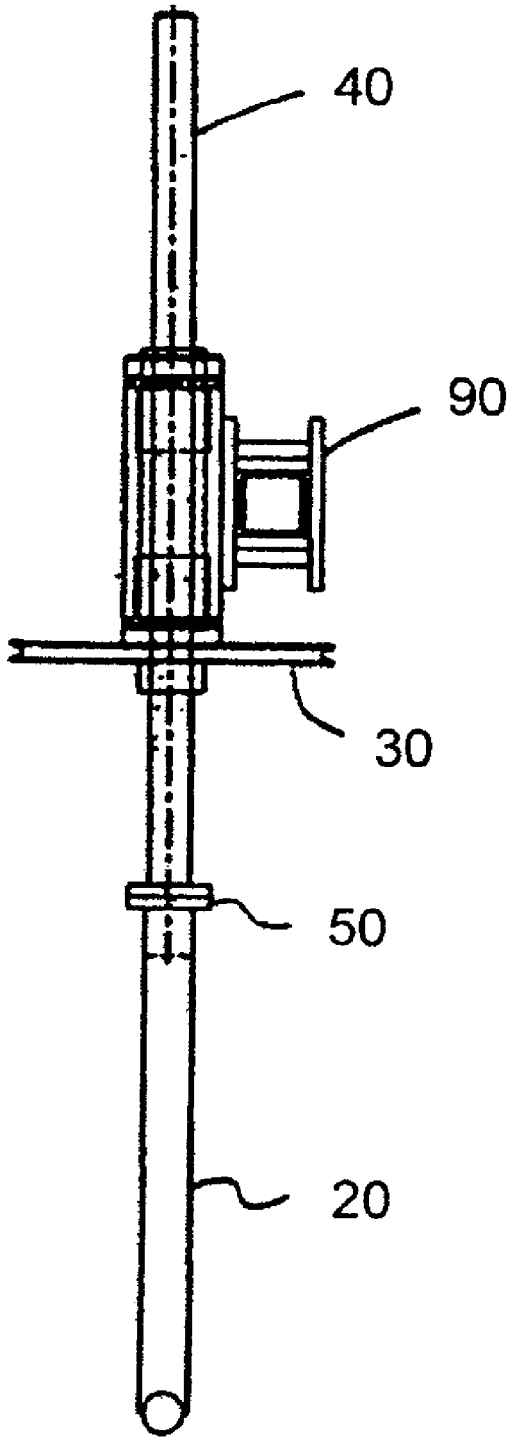
FIG. 7 depicts a side view of the flywheel-yoke-support arm component subassembly in accordance with an embodiment of the present invention.
Figure 8:
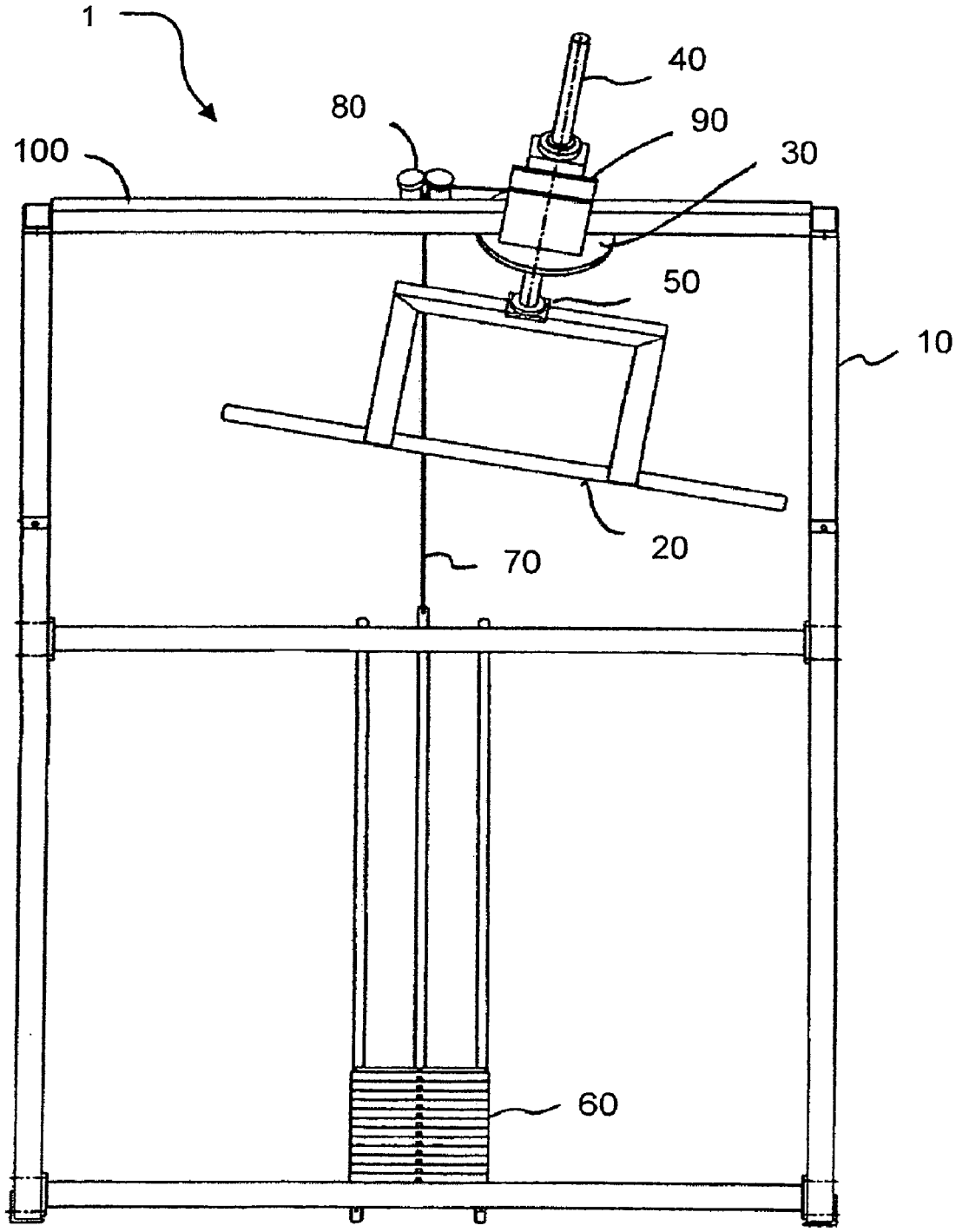
FIG. 8 depicts a front view of a golf exercise device, configured for a left-hand swing, in accordance with an embodiment of the present invention.

Other embodiments of the invention configured for a right-handed swing are displayed in FIGS. 2-5 and 9-12, including an illustrative view of the golf exercise device with the addition of a user performing a right-handed swing, and representative component subassemblies are depicted in FIGS. 6-7. Also included is an illustrative view of the present invention configured for a left-handed swing as shown in FIG. 8.

The position and orientation of the golf exercise device user are generally important to the training and strengthening aspects of the invention. In at least one embodiment of the invention, the position and orientation of a right-handed golfer's spine during the golf swing is at about 30 degrees to vertical (i.e., a forward inclination of about 30 degrees to the right of vertical as reflected by the angle "$\theta$" in the side view of FIG. 2), with about 10-degree lateral tilt (i.e., about 10-degree tilt, or posterior inclination, to the left of vertical as reflected by the angle "$\alpha$" in the front view of FIG. 3). In such embodiments, the axis of rotation of the support arm 40 is at $\theta$=about 30-degrees and $\alpha$=about 10-degrees.

It should be appreciated however that other angular positions and orientations may be employed with this invention and are to be considered within the scope of the present disclosure. For example, the golf exercise device allow the yoke's center of rotation to be adjustable in height and in angular orientation to accommodate different body types and sizes of golfers. Also, for a left-handed golfer, the user's body position would ostensibly be a mirror image of that for a right-handed golfer as depicted in FIG. 8. As such, golf exercise device 1 is adjustable from a right-handed training configuration to left-handed, and vice versa. This is also advantageous because some exercise physiologists believe that it is best to strengthen the muscles in the opposite direction of the primary muscles.

The adjustment capability of the disclosed invention offers the ability to vary the position and orientation of the device in multiple degrees of freedom. These degrees of freedom include, but are not limited to, the height of the yoke's position; the forward inclination of the yoke's center of rotation (i.e., the angle $\theta$ in FIG. 2); the posterior inclination of the yoke's center of rotation (i.e., the angle $\alpha$ in FIG. 3); and the rotation of the support arm 40 about the yoke's center of rotation (i.e., the angle $\beta$ in FIG. 1). Support arm 40 may be adjustable in guide support 90 to accommodate golf exercise device users of varying heights and sizes. In some embodiments, support arm 40 may be adjusted by utilizing a series of spaced bores (as shown in FIG. 6) in support arm 40 through which a securing pin may be inserted to lock the desired height in place. Other temporary locking arrangements may also be used, in other embodiments, such as a locking collar, detents in corporation with spring tensioned bearings, bolt washer and nut configurations, screws and threaded bores, or other suitable arrangements that serve to hold the support arm at the desired height during use of the golf exercise device.

Descriptions of components that are included in various embodiments of the present invention will now be provided with reference to FIGS. 1-12.

As shown in FIG. 1, golf exercise device 1 includes a frame 10 (or "support structure"), having a wide base for providing structural support and stability to the remaining components of golf exercise device 1 and for providing stability to the golfer during performance of the golf swing. Frame 10 comprises a floor-mounted base and a number of vertical, horizontal and diagonal structural support members, as further exemplified in FIGS. 1-5 and 8. The width and spacing of the support members is preferably selected to allow free rotational movement of the yoke 20 (discussed below) and to provide ease of ingress and egress for the user.

Figure 11:
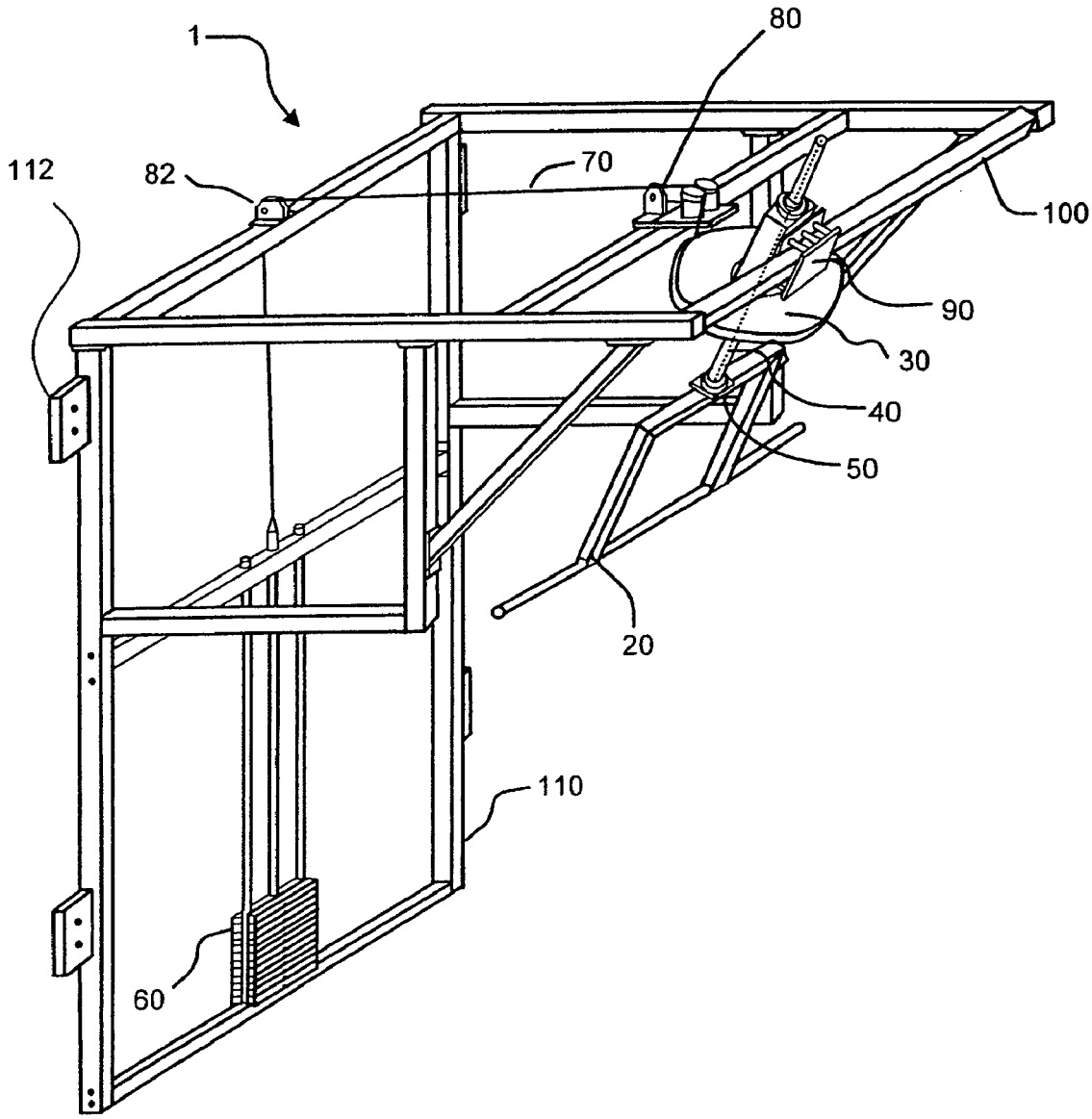
FIG. 11 depicts a left perspective view of a golf exercise device, configured for a right-hand swing, in accordance with an embodiment of the present invention.
Figure 12:
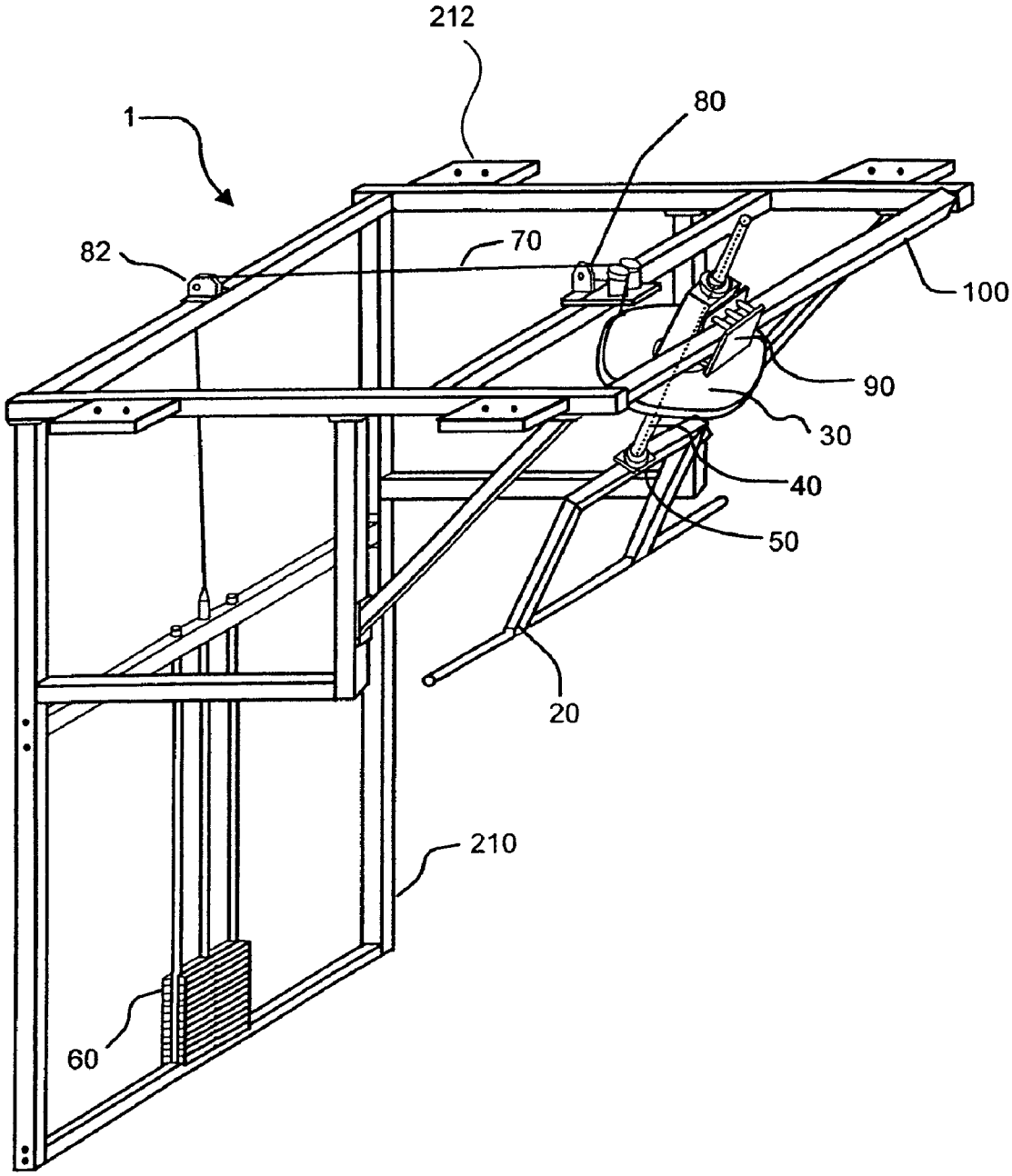
FIG. 12 depicts a left perspective view of a golf exercise machine, configured for a right-hand swing, in accordance with an embodiment of the present invention.

Other configurations of frame 10 that allow freedom of movement for the golfer during performance of the golf swing are to be considered within the scope of the present disclosure. For example, the golf exercise device may be supported from above (i.e., a ceiling-mounted system) or mounted on a side wall or other support structure (i.e., a wall-mounted system), provided that there is adequate structural rigidity to minimize flexibility or movements of the support structure that could interfere with the performance of a proper golf swing. FIG. 11 illustrates an embodiment of the invention where a frame 110 is configured to be mounted on a side wall or other structure. Support brackets 112 may be used to secure frame 110 to a wall or other surface. Alternatively, FIG. 12 illustrates an embodiment of the invention where frame 210 is configured to be supported from above, such as from a ceiling. Support brackets 212 may be used to secure frame 210 to the ceiling.

The various frames of the different embodiments of golf exercise device may be attached to the floor, wall or ceiling by various means, including welding, threaded bolts or screws and/or inserting the frame into a set of grooves or channels designed to hold the frame in place. It should be further be appreciated that in some embodiments the golf exercise device frame may be free standing and mobile. Accordingly, the golf exercise device can be moved to various places within a gymnasium or workout area. In such embodiments, the width and weight of frame 10 prevents exercise device 1 from shifting during use.

Figure 9:
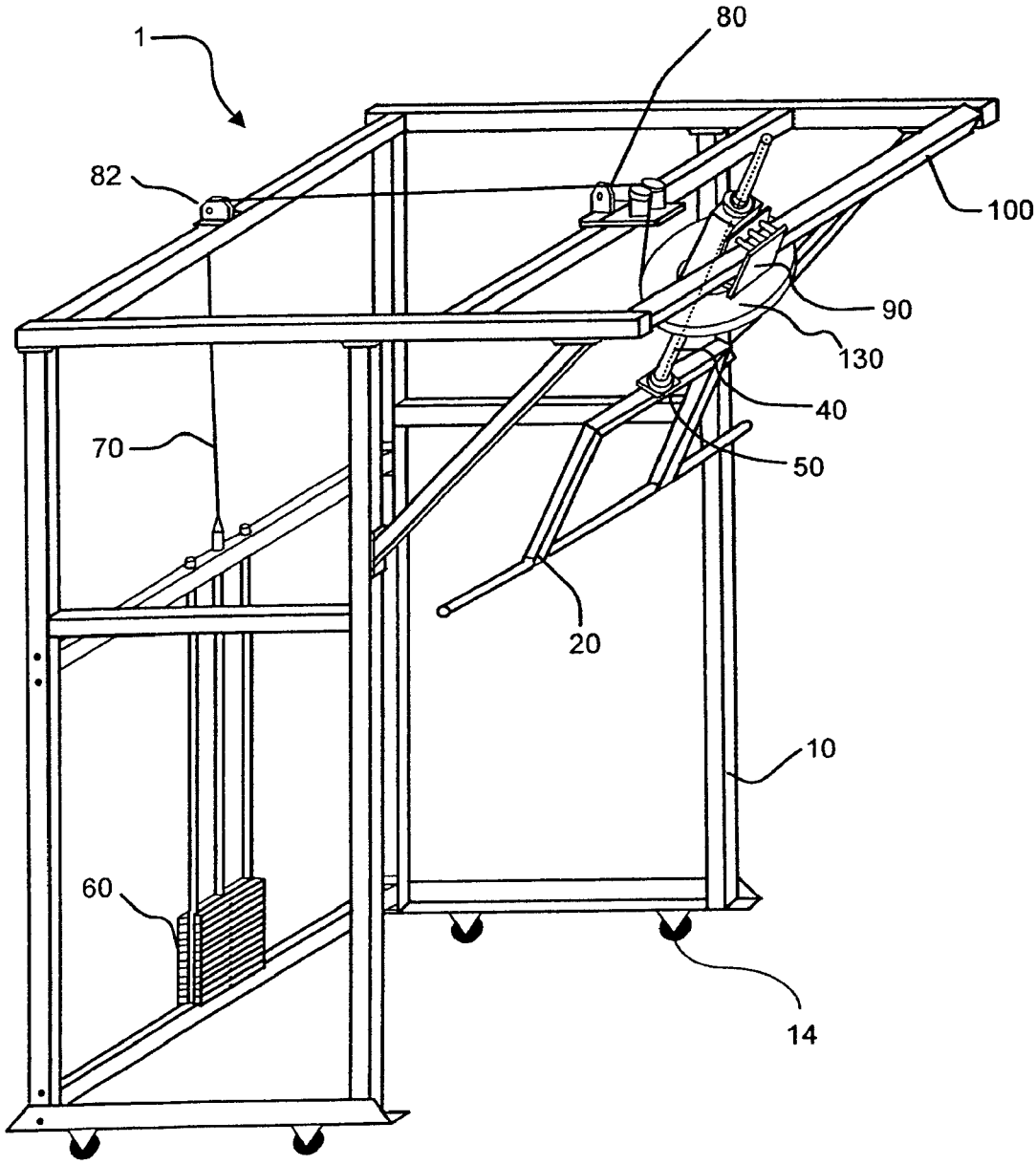
FIG. 9 depicts a left perspective view of a golf exercise device, configured for a right-hand swing, in accordance with an embodiment of the present invention.

In another embodiment, frame 10 may be modified with the addition of wheels or other means of transportability, such that golf exercise device 1 may be readily transported to a golf range or other athletic venue. This would allow the user to use golf exercise device 1 to get the feel of a proper golf swing and then be able to immediately hit real golf shots with actual golf equipment. FIG. 9 illustrates one embodiment of the invention in which wheels 14 are attached to frame 10, such that golf exercise device 1 can be readily transported from one location to another. It should be appreciated that wheels 14 may be configured such that prior to use of golf exercise device 1, they may be prevented from use by a braking or locking mechanism.

Figure 2:
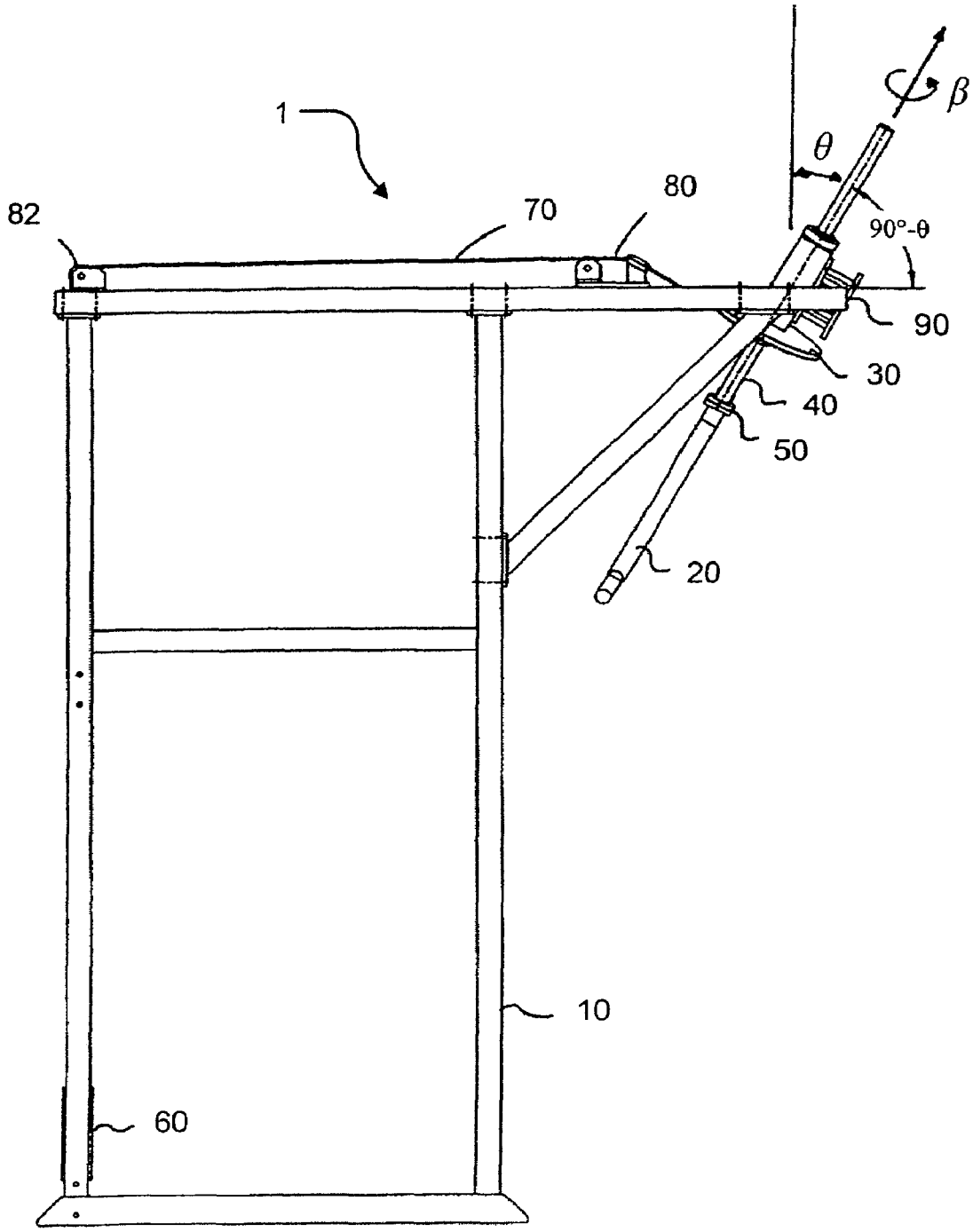
FIG. 2 depicts a left side view of a golf exercise device, configured for a right-hand swing, in accordance with an embodiment of the present invention.
Figure 3:
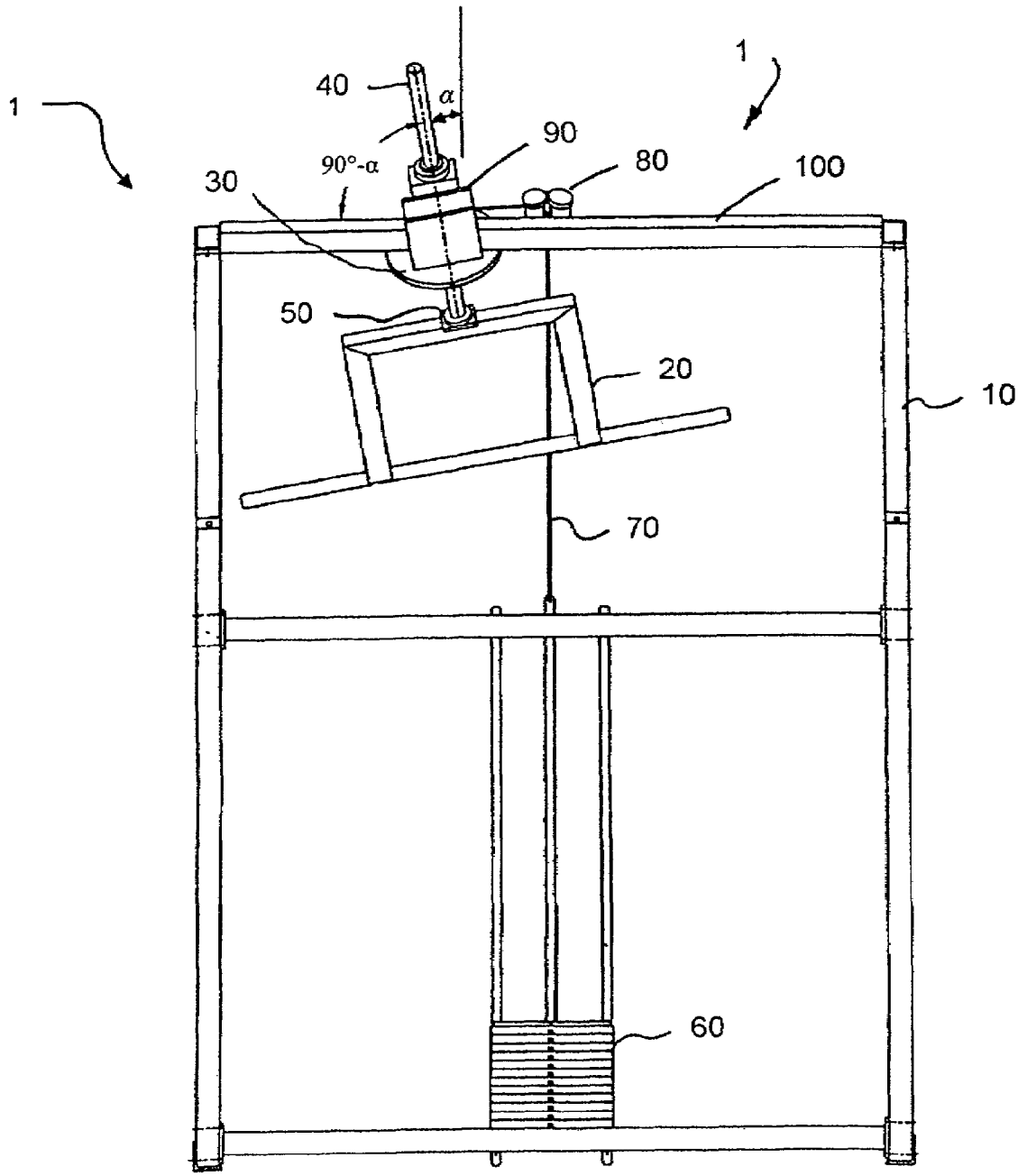
FIG. 3 depicts a front view of a golf exercise device, configured for a right-hand swing, in accordance with an embodiment of the present invention.
Figure 4:
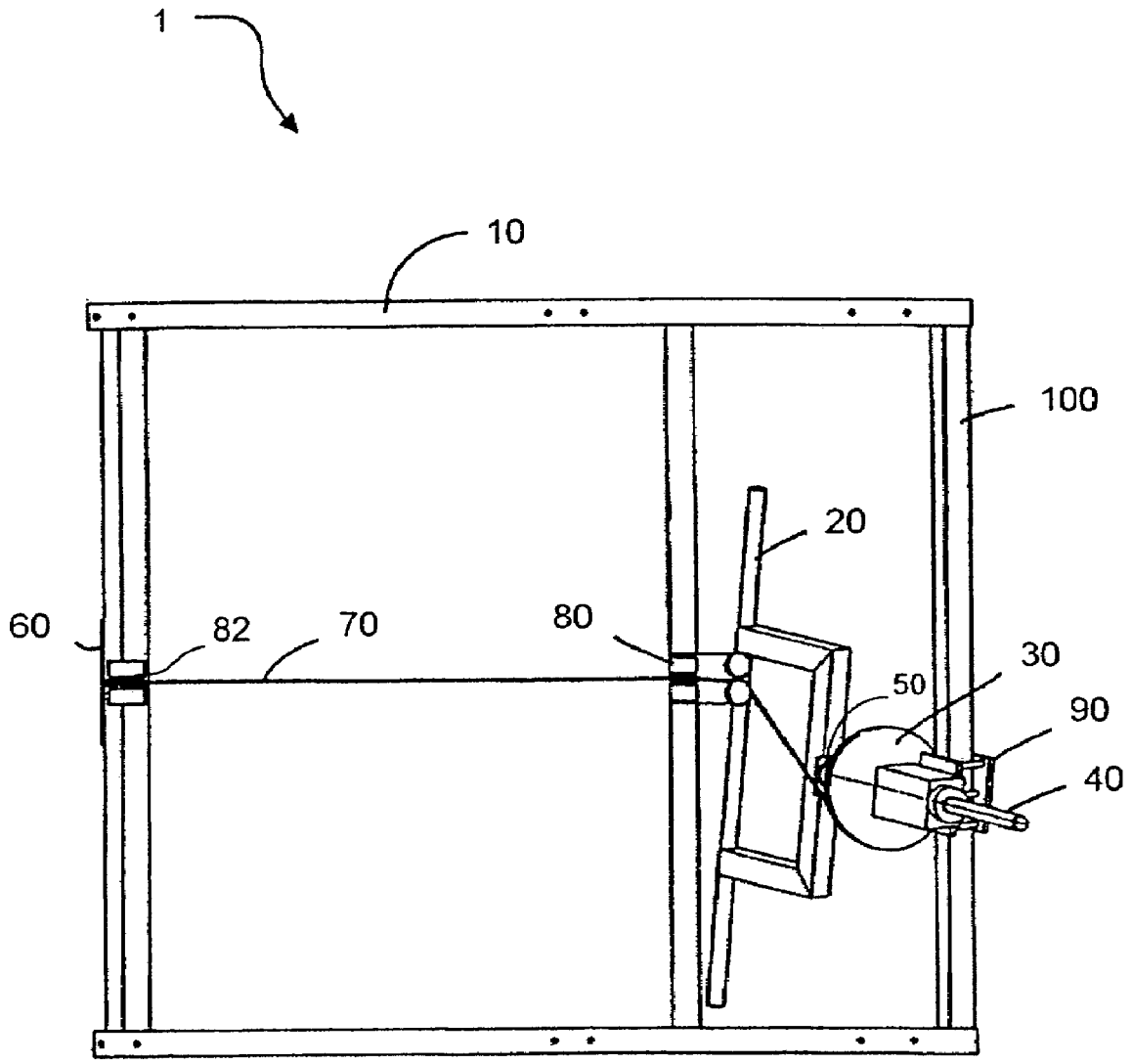
FIG. 4 depicts a top view of a golf exercise device, configured for a right-hand swing, in accordance with an embodiment of the present invention.

To properly simulate the preferred golf swing, golf exercise device 1 employs a flywheel 30 as a pivoting structure to guide the user's body through the correct position for a modern golf swing. As shown in FIG. 5, flywheel 30 is configured so as to allow rotation of the yoke 20 about the spinal axis of the user who will be performing the golf swing while using golf exercise device 1. That is, to achieve the preferred angular orientation for a proper golf swing, the user's spine should be at about 30-degree forward tilt from the waist (i.e., the angle "θ" is about 30 degrees as shown in FIG. 2) and about 10-degree lateral tilt (i.e., the angle "α" is about 10 degrees as shown in FIG. 3). The preferred golf swing is achieved by pivoting about that orientation, and, in doing so by use of golf exercise device 1, the user's body stays aligned in the proper position because the hips cannot advance ahead of the body since the user is restrained by the yoke 20. As such, the body can only turn golf exercise device 1 in sequence during the simulated swing, and all of the muscles used to perform the proper golf swing are utilized, and therefore, strengthened.

As shown in FIG. 1, flywheel 30 is connected to frame 10 through support arm 40, which is in turn slidably connected via a guide support 90 to the uppermost horizontal support bar 100 at the top of frame 10. The orientation of the support arm 40 is coincident with the center or axis of rotation of the flywheel 30. Flywheel 30 may be adjusted for height to accommodate different sized golfers by raising or lowering the support arm 40, but at all times flywheel 30 is supported by frame 10 in a manner to allow free rotation throughout the performance of the golf swing.

Flywheel 30 can easily be rotated in either a clockwise or a counterclockwise direction using the rotational joint 50 and can be switched from the right position for a right-handed golfer to the left position for a left-handed golfer. A configuration of golf exercise device 1 suitable for a left-handed golfer is depicted in FIG. 8. The mechanics and multiple degrees of freedom adjustment capabilities for the left-hand position work as described for the right-handed position. Also, golf exercise device 1 can be utilized to provide resistance to the backswing or through the swing. This is accomplished by switching the rotational direction of the flywheel 30 from clockwise to counterclockwise (and vice versa) by use of the rotational joint 50.

Other means for accomplishing the rotational motion about the user's spine can be employed, if desired, to include the use of an elliptical or non-circular flywheel to provide variable but controllable resistance at different positions of the swing. FIG. 9 illustrates one embodiment of the invention where the shape of flywheel 130 is substantially elliptical.

As shown in FIG. 1, resistance 60 is connected to flywheel 30 (discussed above) through a cable 70 that rides along a first pulley 80 and a second pulley 82 so that as flywheel 30 turns (in response to the user turning yoke 20 during performance of the golf swing), resistance 60 is raised or lowered in response to the performance of the golf swing. Adjusting the amount of resistance selected on resistance 60 allows the user to provide more or less resistance during the swing training.

Figure 10:
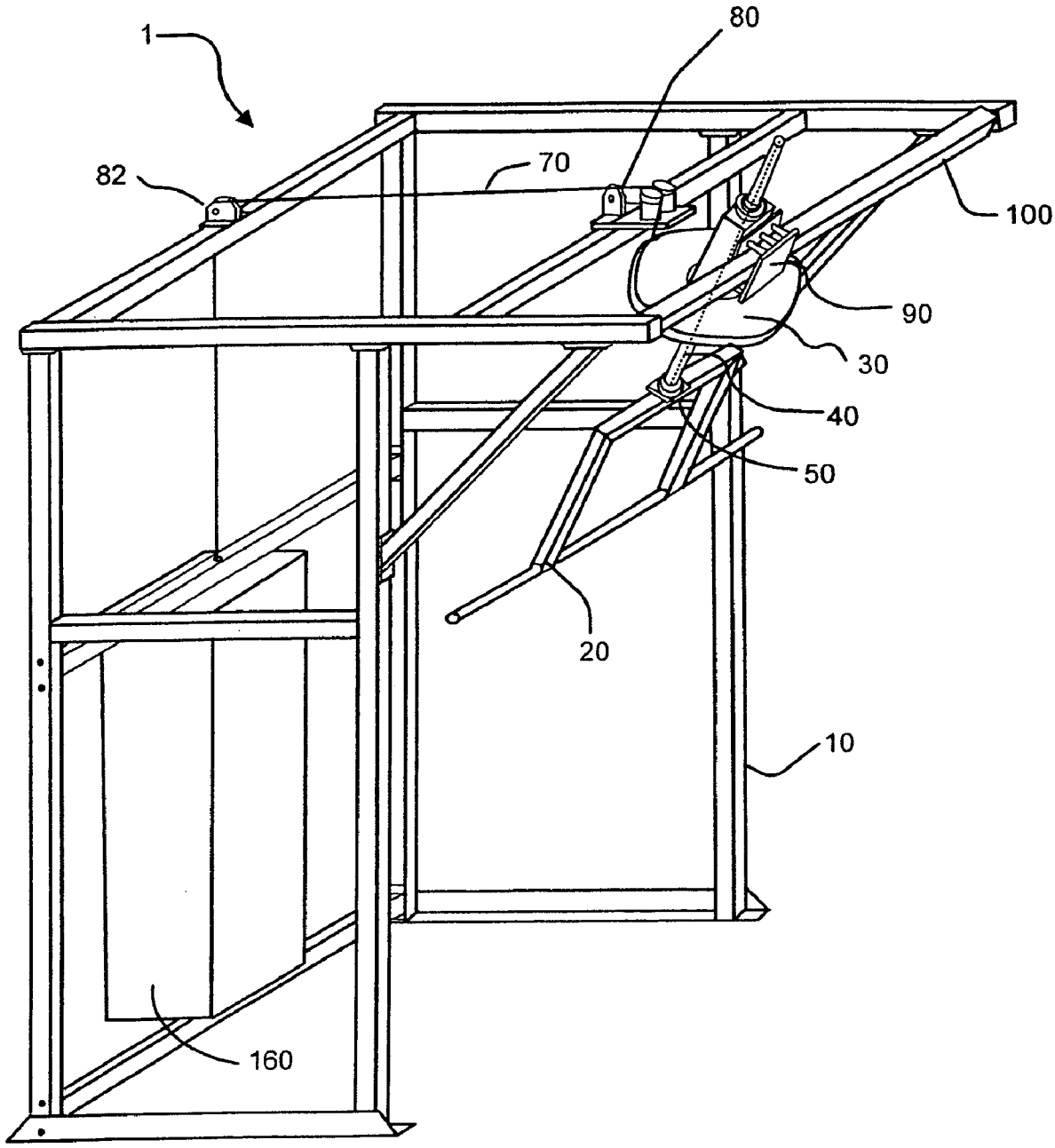
FIG. 10 depicts a left perspective view of a golf exercise device, configured for a right-hand swing, in accordance with an embodiment of the present invention.

Other means for providing resistance training to the user can be employed and are to be considered within the scope of the present disclosure for this invention. These include the use of hydraulic, electromechanical, elastic or other types of variable resistance. FIG. 10 illustrates one embodiment of the invention where resistance 160 may be one of a hydraulic mechanism, an electromechanical mechanism, and an elastic mechanism.

Yoke 20 is rotatably attached to flywheel 30 through joint 50 and support arm 40. Yoke 20 is sized so as to fit around the shoulders of the user, preferably being held in place during normal operation with the user's hands that are naturally held in a forward position to simulate the mechanics of a proper golf swing. As shown in FIG. 5, yoke 20 is in a hands-forward position. Other configurations and hand positions are possible and within the scope of the disclosed invention. Though the user's hands grasp the yoke 20, it is the large rotary muscles of the upper torso and thighs that are actually worked during performance of the golf swing since these muscles are what cause golf exercise device 1 to turn, as opposed to the muscles of the forearms that are worked during use of other conventional golf-swing training devices. Joint 50 is provided between the yoke 20 and the flywheel 30, to allow adjustment of the yoke 20 to accommodate a rotation of 360 degrees so that resistance can be applied to the golf swing in either a right-handed or left-handed configuration, as well as during the backswing or through swing.

In addition to the angular degrees of freedom, θ and α, as shown in FIGS. 2 and 3, respectively, and the height adjustment degree of freedom, an embodiment of this invention allows for adjustment of the angular position of the flywheel 30 about its own center of rotation that is coincident with the lengthwise axis of the support arm 40. This degree of freedom is designated as β in FIG. 2.

Other embodiments of the invention configured for a right-handed swing are displayed in FIGS. 2-5 and 9-12, including an illustrative view of the golf exercise device with the addition of a user performing a right-handed swing, and representative component subassemblies are depicted in FIGS. 6-7. Also included is an illustrative view of the present invention configured for a left-handed swing as shown in FIG. 8.

The position and orientation of the golf exercise device user are generally important to the training and strengthening aspects of the invention. In at least one embodiment of the invention, the position and orientation of a right-handed golfer's spine during the golf swing is at about 30 degrees to vertical (i.e., a forward inclination of about 30 degrees to the right of vertical as reflected by the angle "θ" in the side view of FIG. 2), with about 10-degree lateral tilt (i.e., about 10-degree tilt, or posterior inclination, to the left of vertical as reflected by the angle "α" in the front view of FIG. 3). In such embodiments, the axis of rotation of the support arm 40 is at θ=about 30-degrees and α=about 10-degrees.

Figure 13:
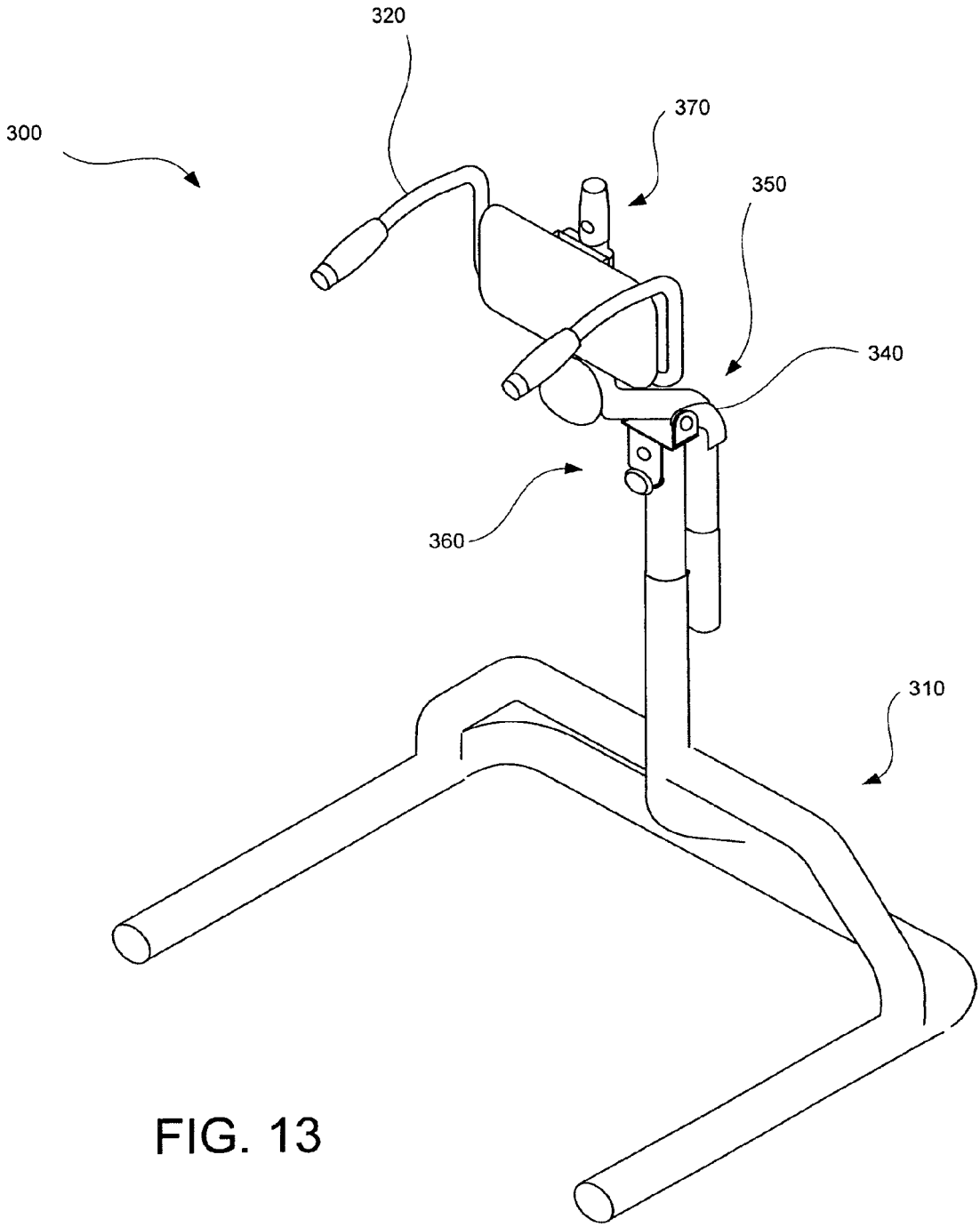
FIG. 13 is a perspective view of a golf exercise device according to an embodiment of the invention.

With reference to FIGS. 13-21, another embodiment of a golf exercise device according to the invention will now be discussed. FIG. 13 illustrates a golf exercise device 300 having a support structure 310 that supports a pivotable support arm 340, a longitudinal pivot control mechanism 350, a lateral pivot control mechanism 360, a yoke 320 and a resistance mechanism 370. The exercise device 300 is configured so that a user standing with his back to the device can grasp the yoke and rotate the yoke 320 through an arc simulating a preferred golf swing, thereby exercising the same rotary muscles that would be used in an actual golf swing. In order to assure that the arc properly matches the golfer's swing, the exercise device 300 has multiple rotational and translational adjustment mechanisms that allow the device 300 to be tailored to the user's stature and swing characteristics. The resistance mechanism 370 provides resistance to the yoke rotation to assist in strengthening the rotational muscles of the back.

Figure 14:
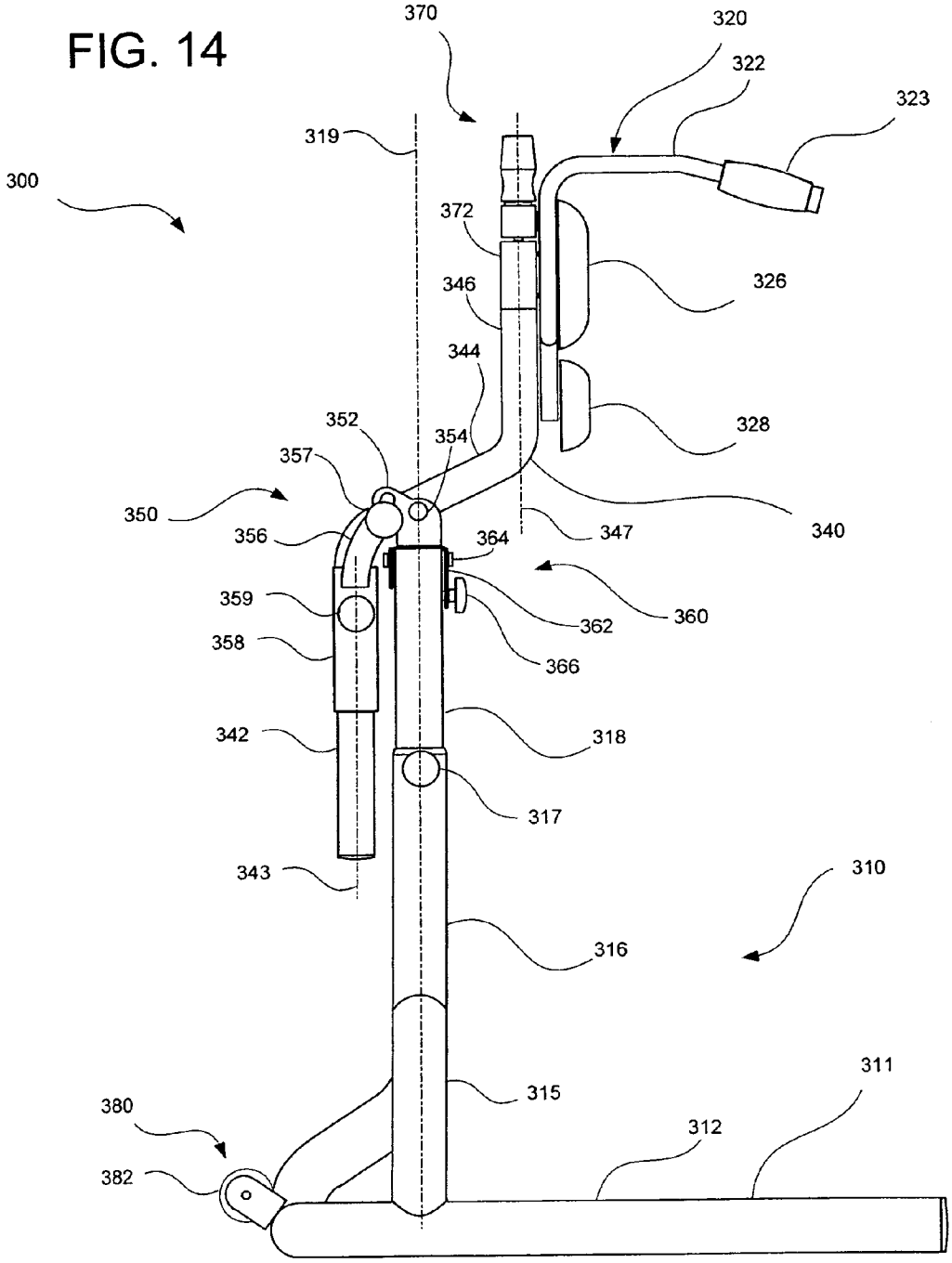
FIG. 14 is a left side view of a golf exercise device according to an embodiment of the invention.
Figure 28:
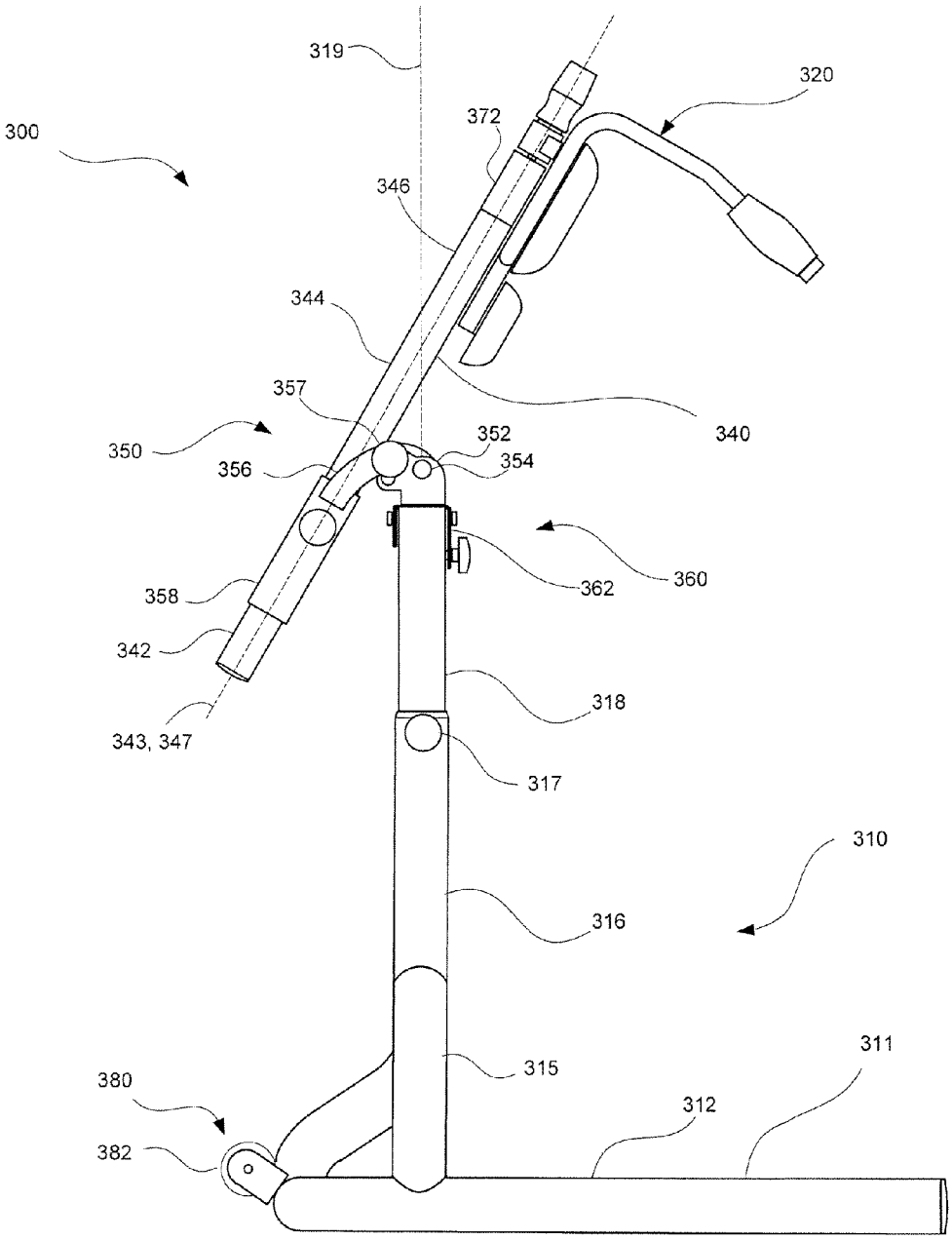
FIG. 28 is a left side view of a golf exercise device according to the invention in which the upper and lower support arm portions are collinear.

The exercise device 300 will now be discussed in more detail. The central component of the exercise device 300 is the pivotable support arm 340, which has a straight lower support arm portion 342, a middle support arm portion 344 and a straight upper support arm portion 346. In some embodiments, the lower, middle and upper support arm portions 342, 344, 346 may be collinear as shown in FIG. 28. As in the illustrated embodiment, however, the middle support arm portion 344 may be used to provide an offset between the lower support arm portion 342 and the upper support arm portion 346. The upper and lower support arm portions 342, 346 have parallel axes 343, 347, which, in the vertical configuration shown in FIG. 14, are also parallel to a vertical axis 319 of the device 300. A yoke attachment sleeve 372 is pivotably attached to the upper end of the upper support arm portion 346 so that it is freely rotatable about the upper support arm axis 347. As will be discussed in more detail below, the resistance mechanism 370 may be attached to the yoke attachment sleeve 372 so as to provide resistance to the free rotation of the yoke attachment sleeve 372.

As shown in FIGS. 13-17, the pivoting yoke 320 may be formed in a bent U-shape to resemble bicycle handlebars. In the illustrated embodiment, the yoke 320 has left and right side members 322, 324 connected at their proximal end by a lower cross-member 325. Handgrips 323 may be attached to the distal ends of the side members 322, 344 to facilitate the user's grip on the yoke. The side members 322, 324 are L-shaped and extend upward and forward from the lower cross member 325. Two central cross-members 327 connect to the left and right side members 322, 324. These central cross-members 327 may be used to attached the yoke 320 to the yoke attachment sleeve 372. By fixedly attaching the yoke 320 to the yoke attachment sleeve 372, the yoke 320 can be rotated with the yoke attachment sleeve 372 about the upper support arm axis 347.

Figure 17:
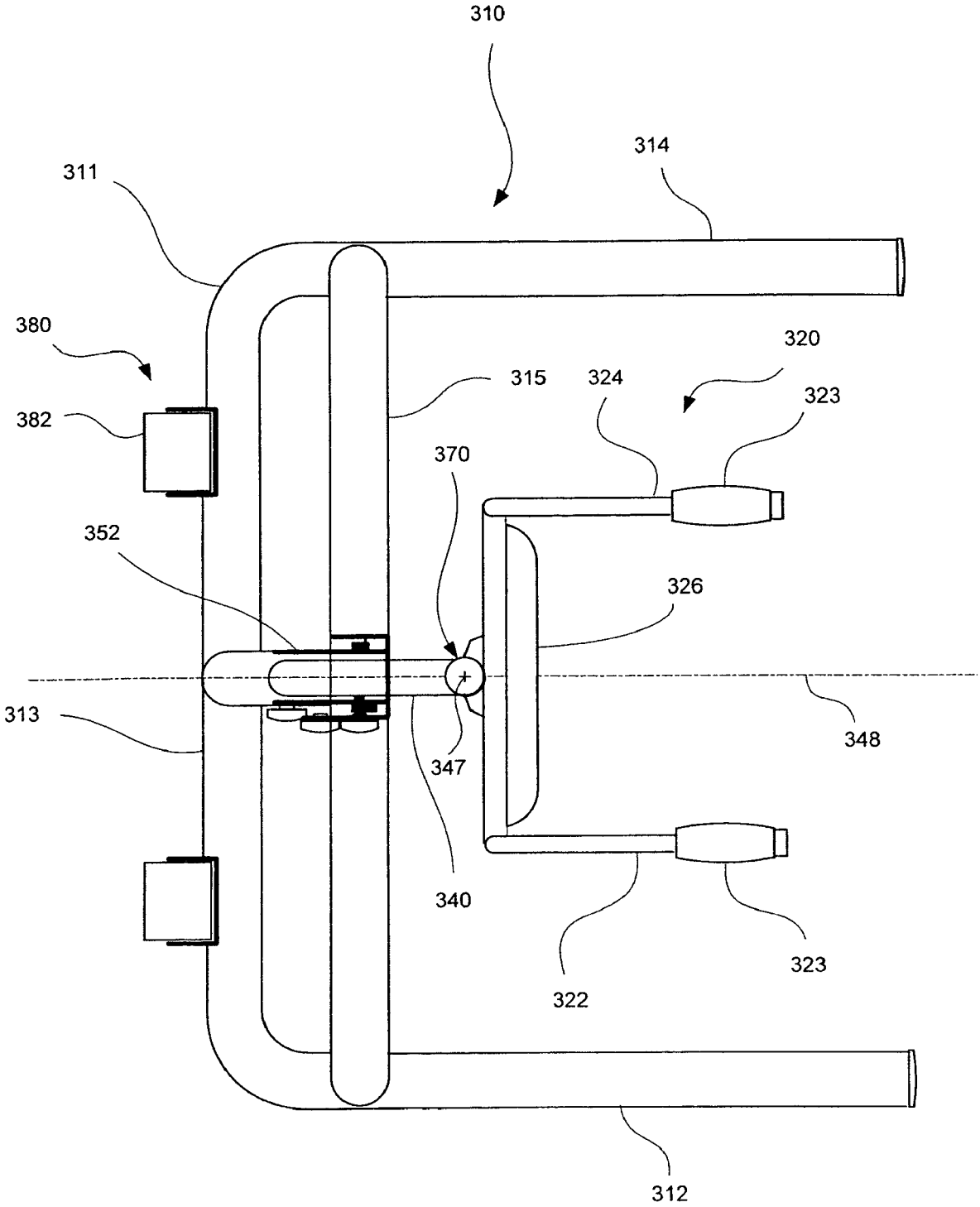
FIG. 17 is a top view of a golf exercise device according to an embodiment of the invention.
Figure 18:
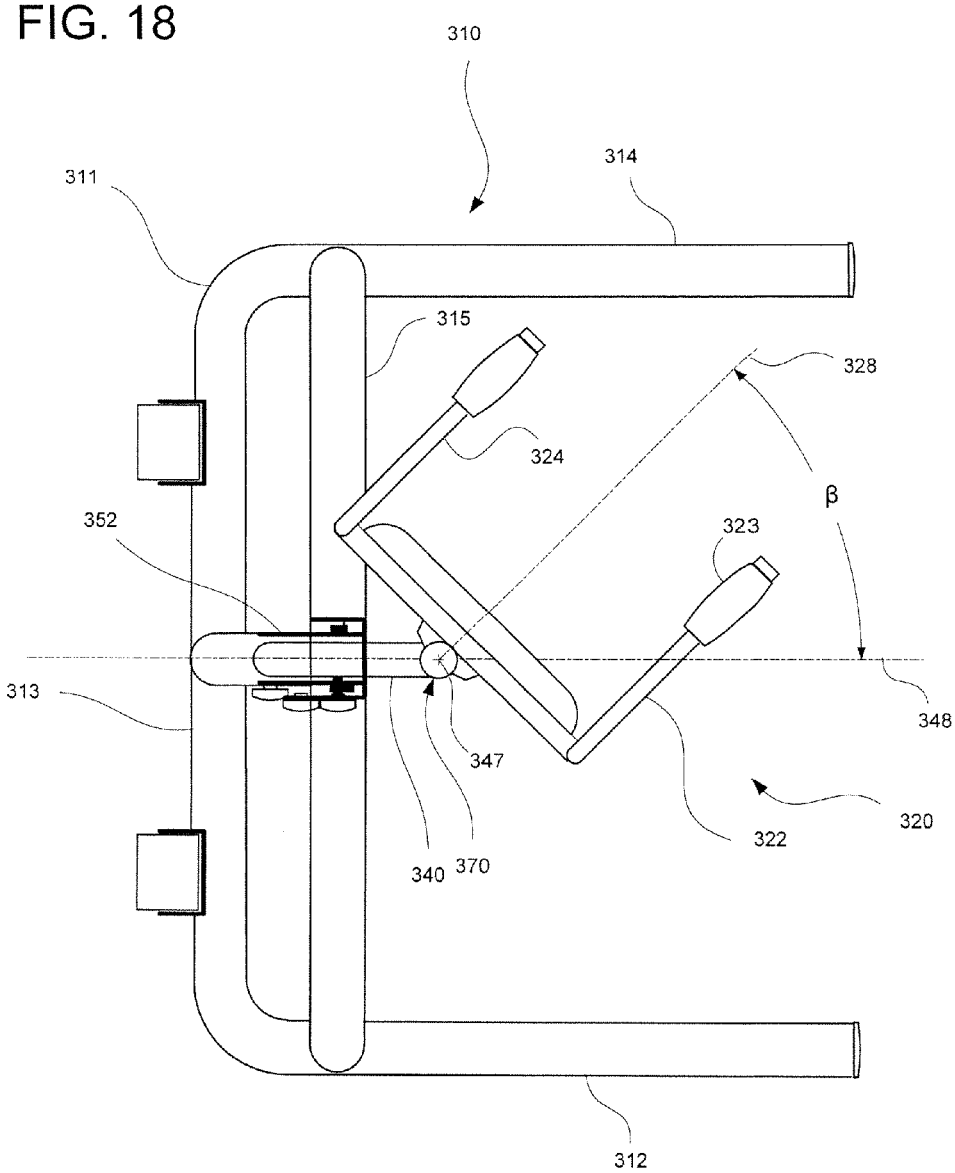
FIG. 18 is a top view of the golf exercise device of FIG. 16 with the yoke pivoted about the axis of the upper portion of the support arm.

FIGS. 17 and 18 illustrate the rotation of the yoke 320 about the upper support arm axis 347. In the neutral (i.e., un-rotated) position shown in FIG. 17, the side members 322, 324 are roughly parallel to a longitudinal axis 348 through the center of the yoke attachment sleeve. The longitudinal axis 348 is coplanar with the centerline of the support arm 340. When the yoke is rotated as shown in FIG. 18, the yoke axis 328 forms a yoke rotation angle β with the longitudinal axis 348.

The yoke 320 may include one or more pads that allow the user to brace himself against the yoke 320 while using the exercise device 300. As shown in the illustrated embodiment, a first pad 326 may be positioned on the yoke 320 so that it may be engaged by the user's upper back or shoulder blades. A second pad 328 may be positioned below the first pad 326 to provide a brace for the user's spine.

The pivotable support arm 340 is supported and held in place by the longitudinal pivot control mechanism 350 and the lateral pivot control mechanism 360, which serve to connect the pivotable support arm 340 to the support structure 310. In the illustrated embodiment, the support structure 310 comprises a base 311, a primary support column 316, a lateral brace 315 and a secondary support column 318. The base comprises left, right and rear base members 312, 314, 313, respectively, that combine to provide a stable platform for the exercise device 300. The primary support column 316 is connected to and extends forward and upward from the rear base member 313. The lateral brace 315 connects the left and right base members 312, 314 and the primary support column 316. The portion of the primary support column 316 extending upward from the lateral brace 315 is substantially vertical and defines a vertical axis 319.

The primary support column 316 may be formed as a tube member that is adapted to slidably receive at least a portion of the secondary support column 318. When inserted into the primary support column 316, the exposed length of the secondary support column 318 may be adjusted by translating the secondary support column 318 up or down. This effectively adjusts the overall height of the exercise device 300. Once the desired height is established, a knobbed locking screw 317 threaded through a hole in the wall of the primary support column 316 may be used to hold the secondary support member 318.

It will be understood that the above-described support structure is one of many that could be used with the exercise device 300. Any structure that provides a solid base for the device and allows for free relative movement and rotation of the device components may be used.

The longitudinal pivot control mechanism 350 and the lateral pivot control mechanism 360 serve to attach the pivotable control arm 340 to the support structure 310. They are also adapted to allow the user of the exercise device 300 to adjust the longitudinal angle (i.e., the amount of forward pitch from the vertical) and the lateral angle (i.e., the sideways tilt from the vertical). The longitudinal pivot control mechanism 350 includes a longitudinal pivot bracket 352 that is attached to the upper end of the secondary support column 318 by the lateral pivot control mechanism 360 as discussed below. A pair of pivot arms 356 are each pivotably connected at one end to the longitudinal pivot bracket 352 and at the opposite end to a support arm adjustment sleeve 358. The support arm adjustment sleeve 358 is configured to slidably receive the lower support arm portion 342. When the lower support arm portion is inserted into the support arm adjustment sleeve 358, the height of the yoke 320 relative to the top of the secondary support column 318 may be adjusted up or down by raising or lowering the support arm 340. This not only adjusts the overall height of the exercise device, it also adjusts the relative positions of the three main pivot points of the device 300. Once the desired position is established, a knobbed locking screw 359 threaded through a hole in the wall of the support arm adjustment sleeve 358 may be used to brace the support arm 340 and hold it in place.

Figure 19:
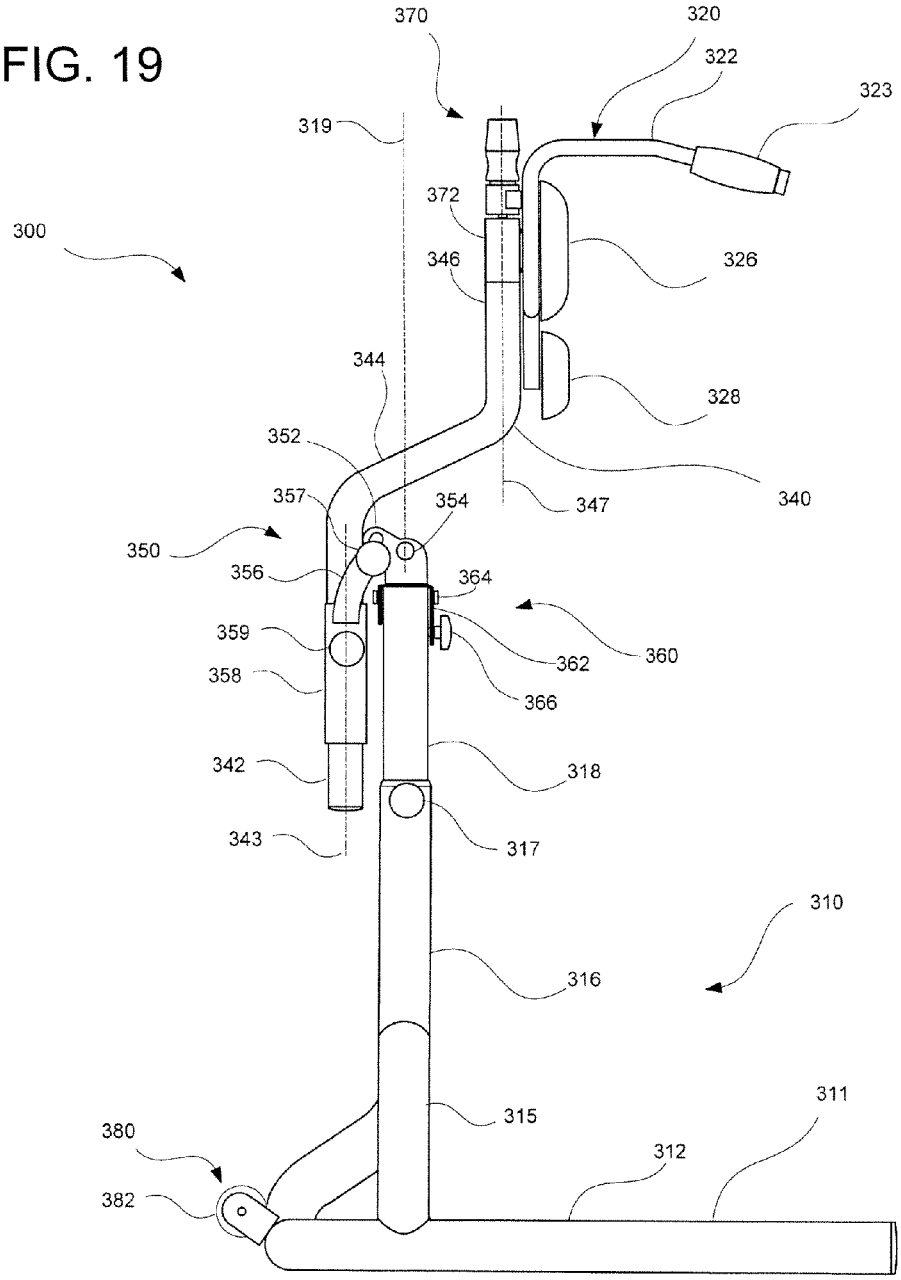
FIG. 19 is a left side view of the golf exercise device of FIG. 14 illustrating the adjustability of the height of the yoke of the device relative to the longitudinal and lateral pivot points.

A comparison of FIGS. 14 and 19 illustrates the effect of adjusting the position of the pivotable support arm 340 in the support arm adjustment sleeve 358. FIG. 14 shows the support arm 340 in its lowest position relative to the adjustment sleeve 358. FIG. 19 shows the support arm 340 in a partially raised position, which has the effect of moving the yoke rotation point (i.e., the yoke attachment sleeve 372) upward relative to the longitudinal and lateral pivot points 354, 364.

The forward end of each of the pivot arms 356 is pivotably connected to the longitudinal pivot bracket 352 at the longitudinal pivot 354. This allows the yoke 320, the support arm 340 and the support arm adjustment sleeve 358 to rotate as a unit about the longitudinal pivot 354 so that the forward angle of the support arm 340 can be adjusted. Once the desired pitch angle has been established, the pivot arms 356 may be locked in place using a locking knob 357.

Figure 20:
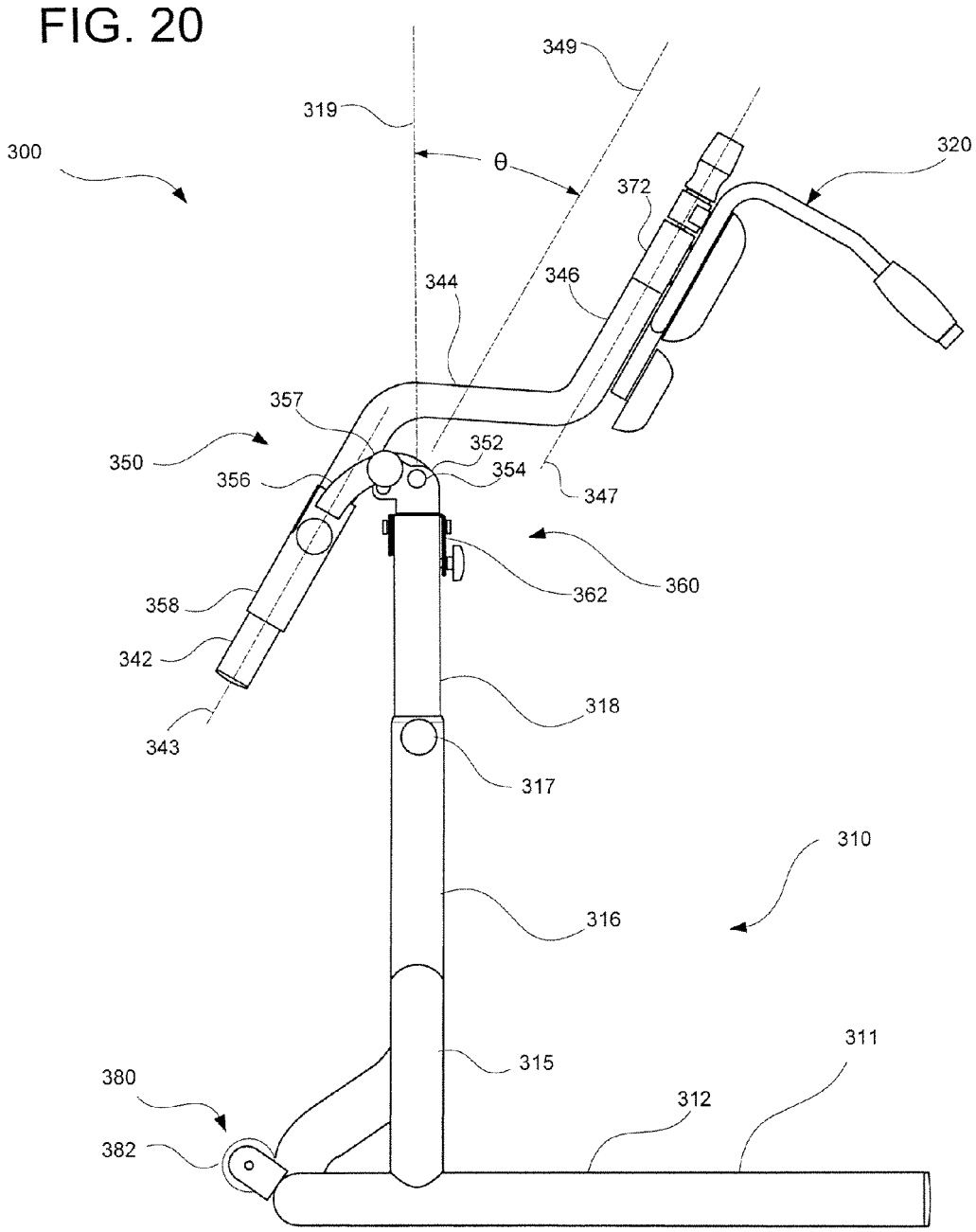
FIG. 20 is a left side view of the golf exercise device of FIG. 14 with the support arm and yoke pivoted forward.

FIGS. 19 and 20 illustrate the establishment of a forward pitch angle by rotation of the support arm 340 about the longitudinal pivot 354. The support arm 340 has a central support arm axis 349 that passes through the longitudinal pivot 354. The central support arm axis 349 is parallel to the lower support arm axis 343 defined by the lower support arm portion 342 and the upper support arm axis 347 defined by the upper support arm 346. In the vertical position shown in FIG. 19, the central support arm axis is collinear with the vertical axis 319. When rotated forward as shown in FIG. 20, the central support arm axis 349 establishes a pitch angle $\theta$. As previously discussed, this angle is ideally set at the angle formed by a user's spine when the user addresses a golf ball. This assures that the upper support arm portion 346 will be substantially parallel to the user's spine when the user adopts this position during use of the exercise device 300. It also assures that yoke rotation by the user is limited to a plane that it is orthogonal to the user's spine when in this position, thereby assuring that the user maintains the proper rotation and exercises the correct muscles.

As noted above, the longitudinal pivot control mechanism 350 is attached to the secondary support column 318 by the lateral pivot control mechanism 360. Specifically, the longitudinal pivot bracket 352 is attached to a lateral pivot bracket 362, which is pivotably attached to the secondary support column 318 at a pivot 364. This allows the yoke 320, the support arm 340, the support arm adjustment sleeve 358 and the longitudinal pivot control mechanism 350 to rotate as a unit about the lateral pivot 364 so that the sideways tilt angle of the support arm 340 can be adjusted. Once the desired tilt angle has been established, the lateral pivot bracket 362 may be locked in place using a locking knob 366.

Figure 15:
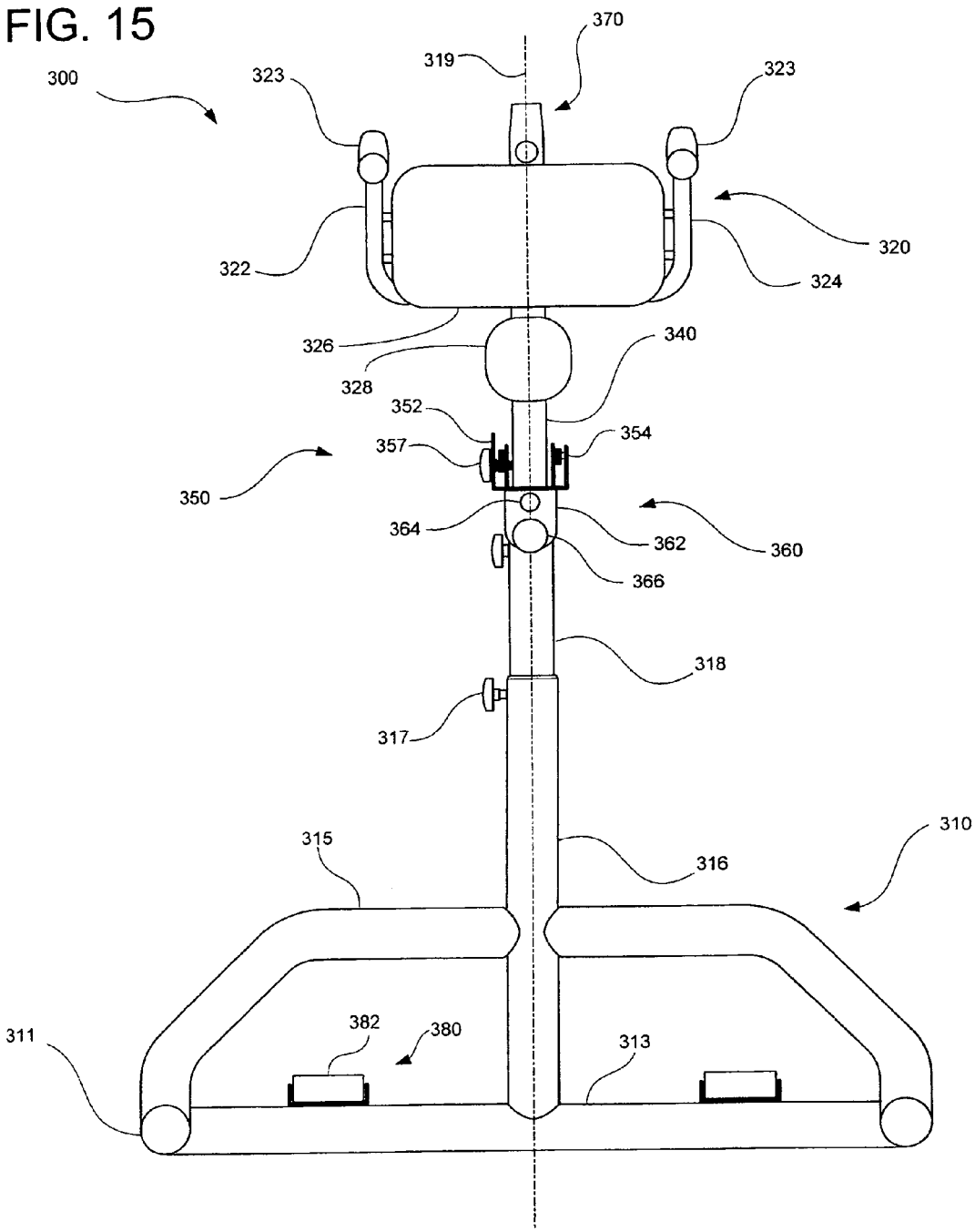
FIG. 15 is a front view of a golf exercise device according to an embodiment of the invention.
Figure 16:
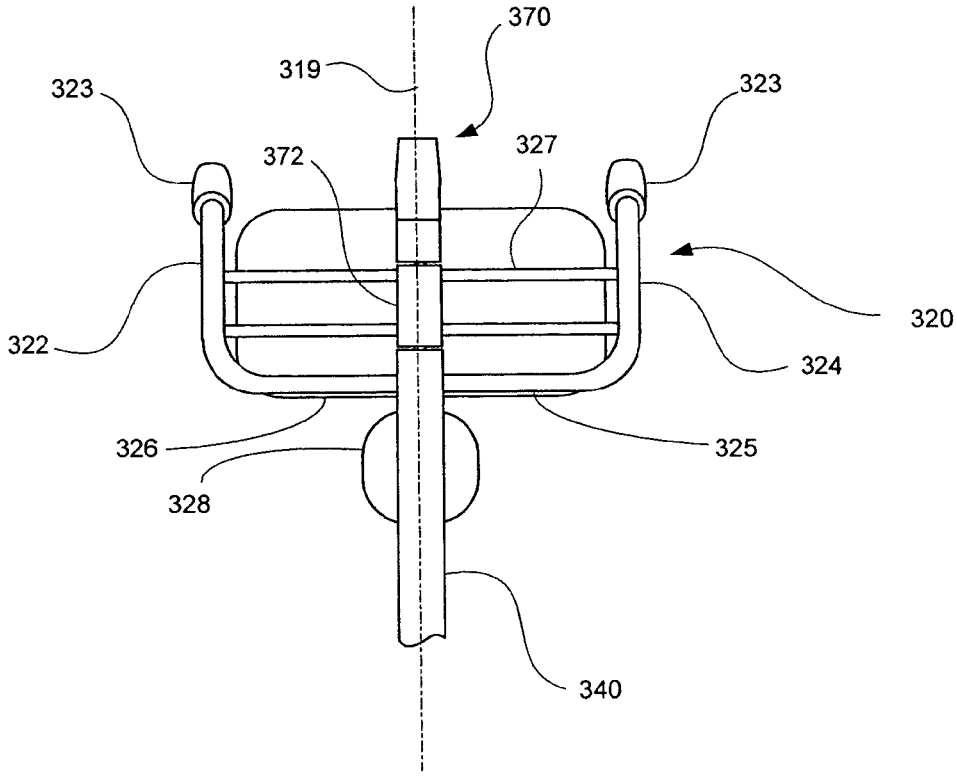
FIG. 16 is a rear view of the upper portion of a golf exercise device according to an embodiment of the invention.
Figure 21:
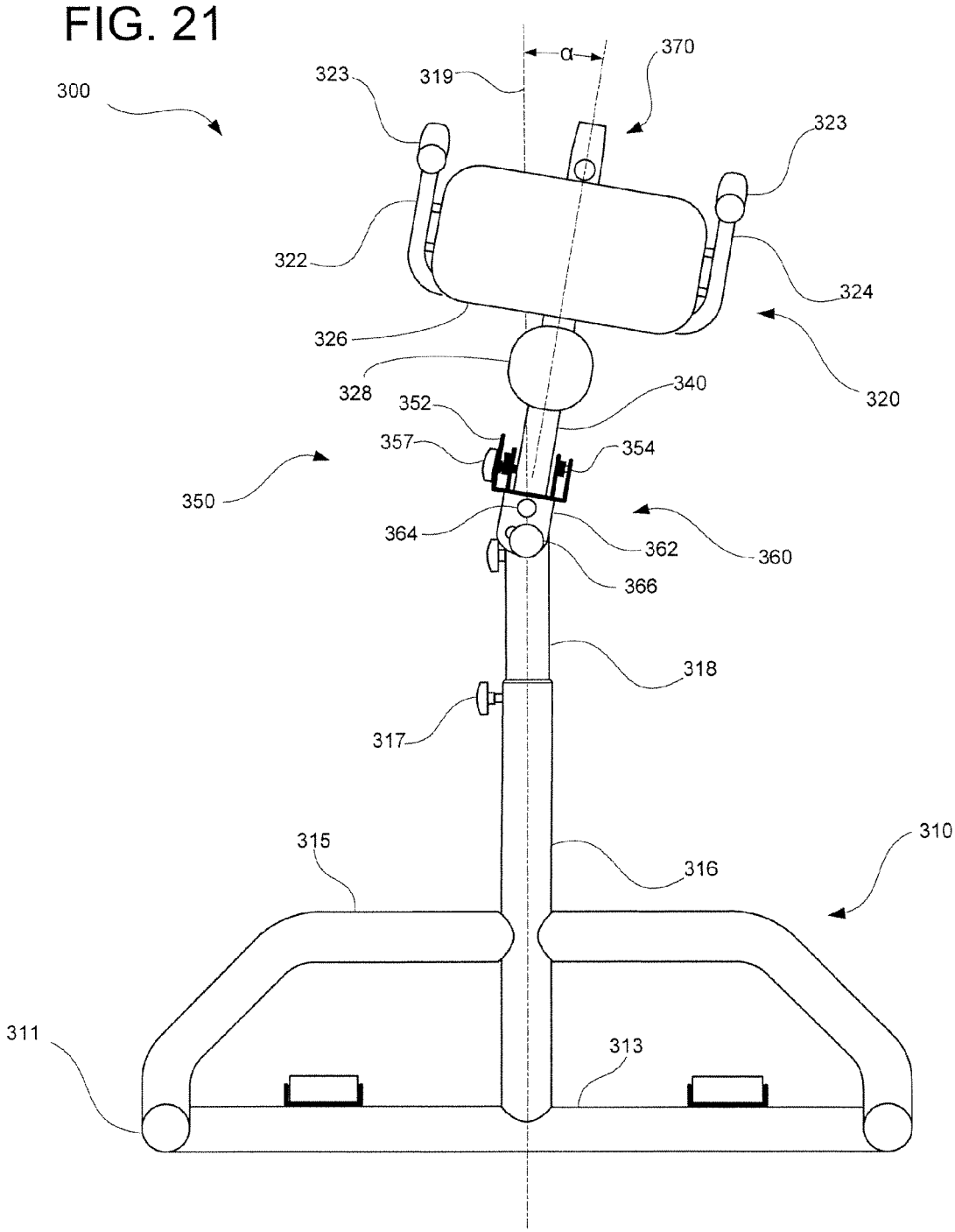
FIG. 21 is a front view of the golf exercise device of FIG. 15 with the support arm and yoke pivoted laterally.

FIGS. 15 and 21 illustrate the establishment of a sideways tilt angle by rotation of the lateral pivot bracket 362 about the lateral pivot 364. FIG. 15 shows the device 300 in its fully vertical configuration. As previously noted, when the support arm 340 is in its vertical position, the central support arm axis 349 is collinear with the vertical axis 319. When the lateral pivot bracket 362 is pivoted about the lateral pivot 364 as shown in FIG. 21, the central support arm axis 349 establishes a lateral tilt angle $\alpha$. As previously discussed, this angle is ideally set at the amount to which a user tilts his upper body left or right when the user addresses a golf ball. Typically a right-handed golfer will have a tilt toward the left (from the user's perspective) as shown in FIG. 21.

In order to use the exercise device 300 in the preferred manner, a user first adjusts the forward pitch angle $\theta$ and the lateral tilt $\alpha$ to his stature and the desired swing profile. The user then places his upper back against the pad 326 of the yoke 320 and grasps the handgrips 323. If properly configured, the upper support arm axis 347 should be parallel to the user's spine. The user then rotates the yoke 320 about the upper support arm axis 347 to simulate the rotation of a golf swing. This serves to twist the user's body around a "fixed spine."

As noted above, the exercise device 300 comprises a resistance mechanism 370 that serves to oppose the rotation of the yoke 320 with a pre-selected degree of resistance. The resistance mechanism 370 may incorporate virtually any form of mechanism that allows for adjustable resistance to rotation of a tube or shaft. In a particular embodiment, the resistance mechanism may comprise mechanical cone resisters which may be configured to provide resistance in both directions, forward and back, right or left handed. This form of resistance mechanism 370 can be adjusted to an almost infinite variety of resistance by a simple turn of a resistance knob.

It will be understood that in some embodiments, the resistance mechanism 370 may incorporate weight-based resistances similar to those described for exercise device 1 of FIGS. 1-12. In such embodiments, a flywheel or pulley wheel may be directly or indirectly connected to the yoke attachment sleeve 372 so that it rotates about the upper support arm axis 347 with the yoke 320. The flywheel or pulley wheel may be shaped so as to provide a constant resistance or a variable resistance depending on the yoke rotation angle $\beta$.

In other embodiments, hydraulic, electromechanical, elastic or other types of variable resistance may be applied to resist rotation of the yoke attachment sleeve 372. Alternatively, such mechanical resistance devices may be connected to the yoke 320 itself which would then act as a moment arm to counter its own rotation.

The exercise device 300 may be constructed in a relatively compact form of lightweight materials. The device 300 may also be equipped with wheels to facilitate its portability. In the illustrated embodiment, the exercise device 300 includes two wheel assemblies 380 attached to the rear base member 313. These wheel assemblies 380 are positioned so that the wheels 382 do not support any of the weight of the device 300 when in its upright, operating position. When the support structure 310 is tilted rearward, however, the weight of the device 300 is placed on the wheels 382 so that the device can be moved in a similar manner to a handcart.

Figure 22:
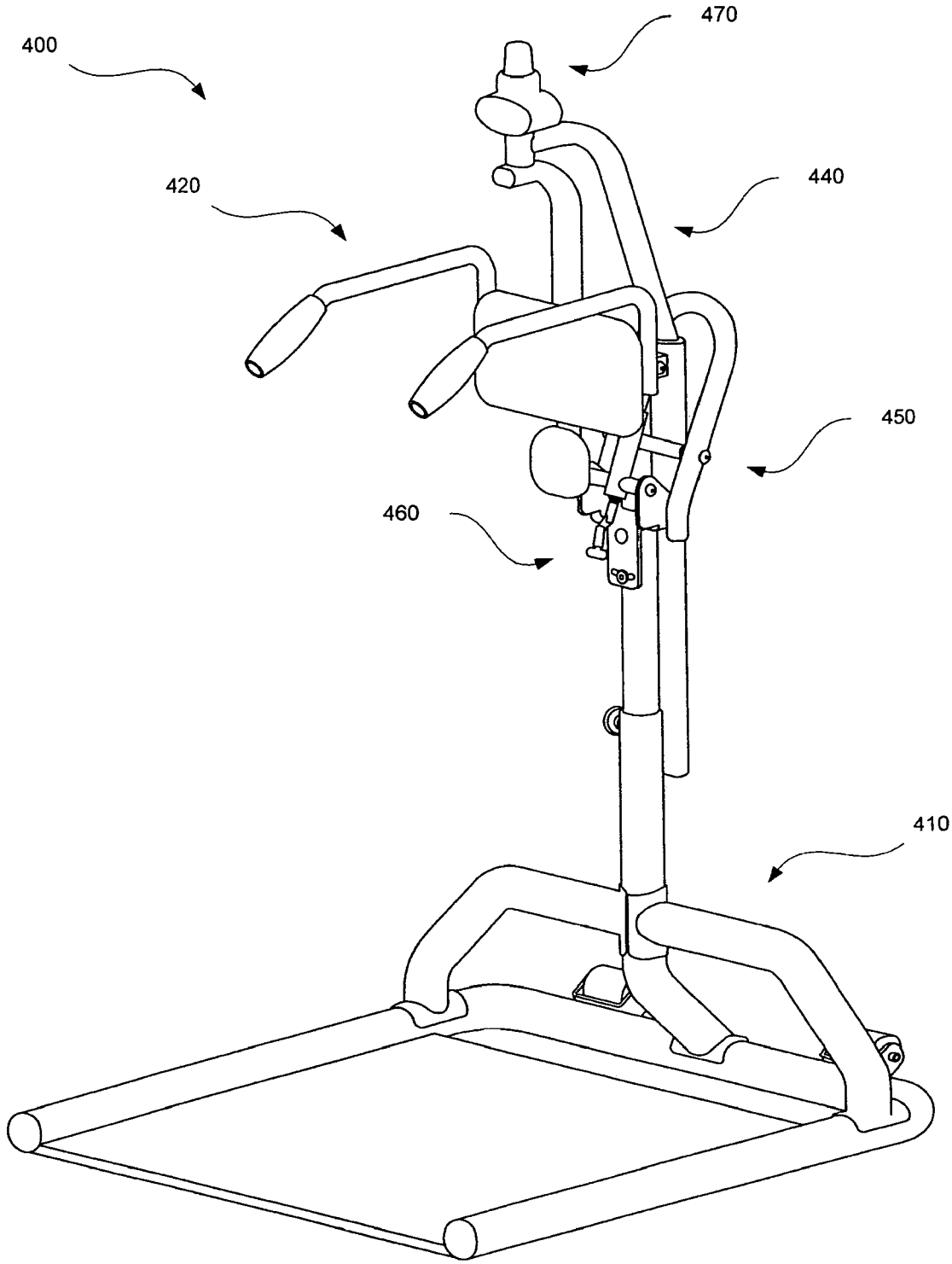
FIG. 22 is a perspective view of a golf exercise device according to an embodiment of the invention that may be adjusted so that a yoke axis of rotation is coaxial or nearly coaxial to an axis through a users spine.
Figure 23:
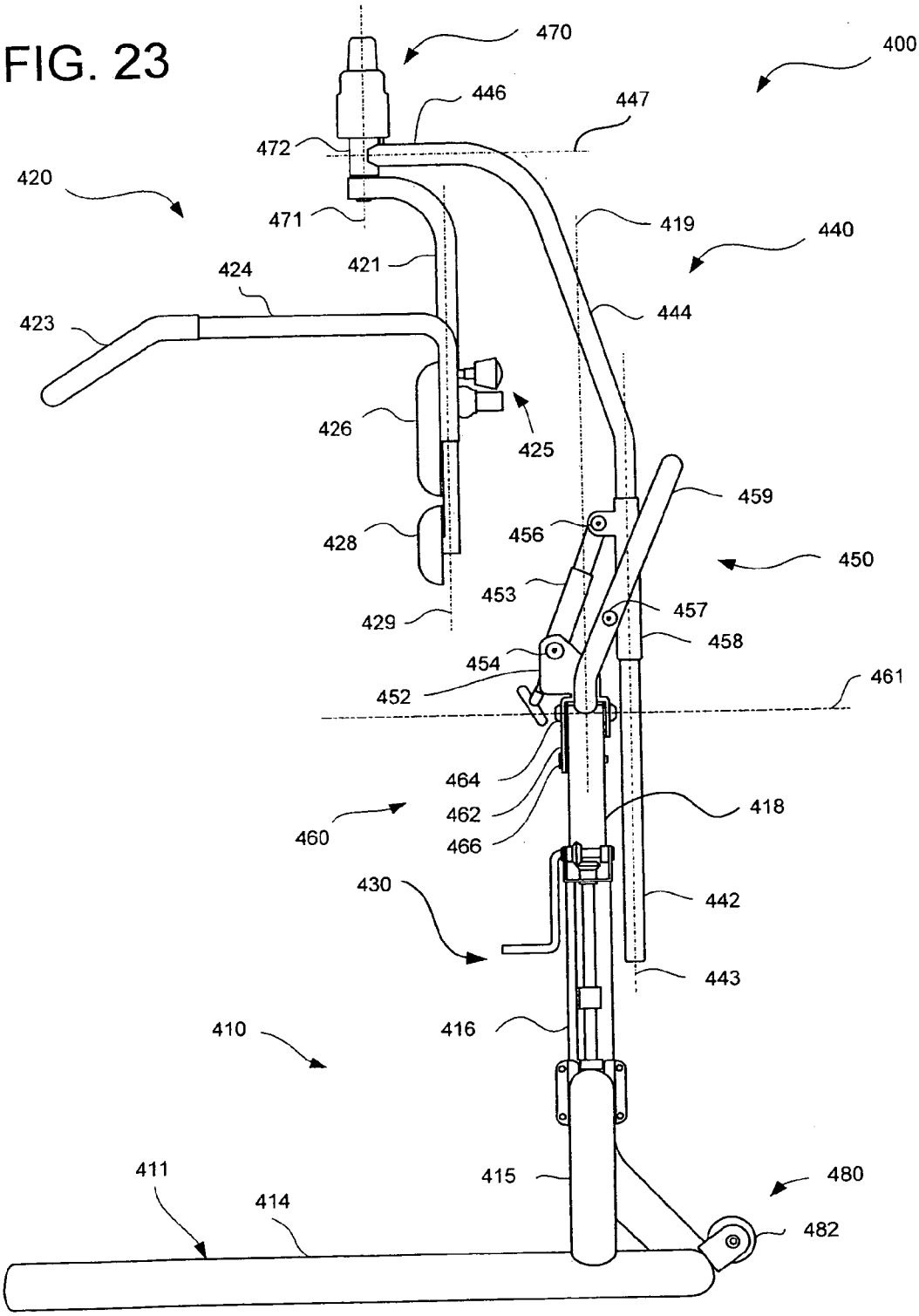
FIG. 23 is a right side view of the exercise device of FIG. 22.
Figure 24:
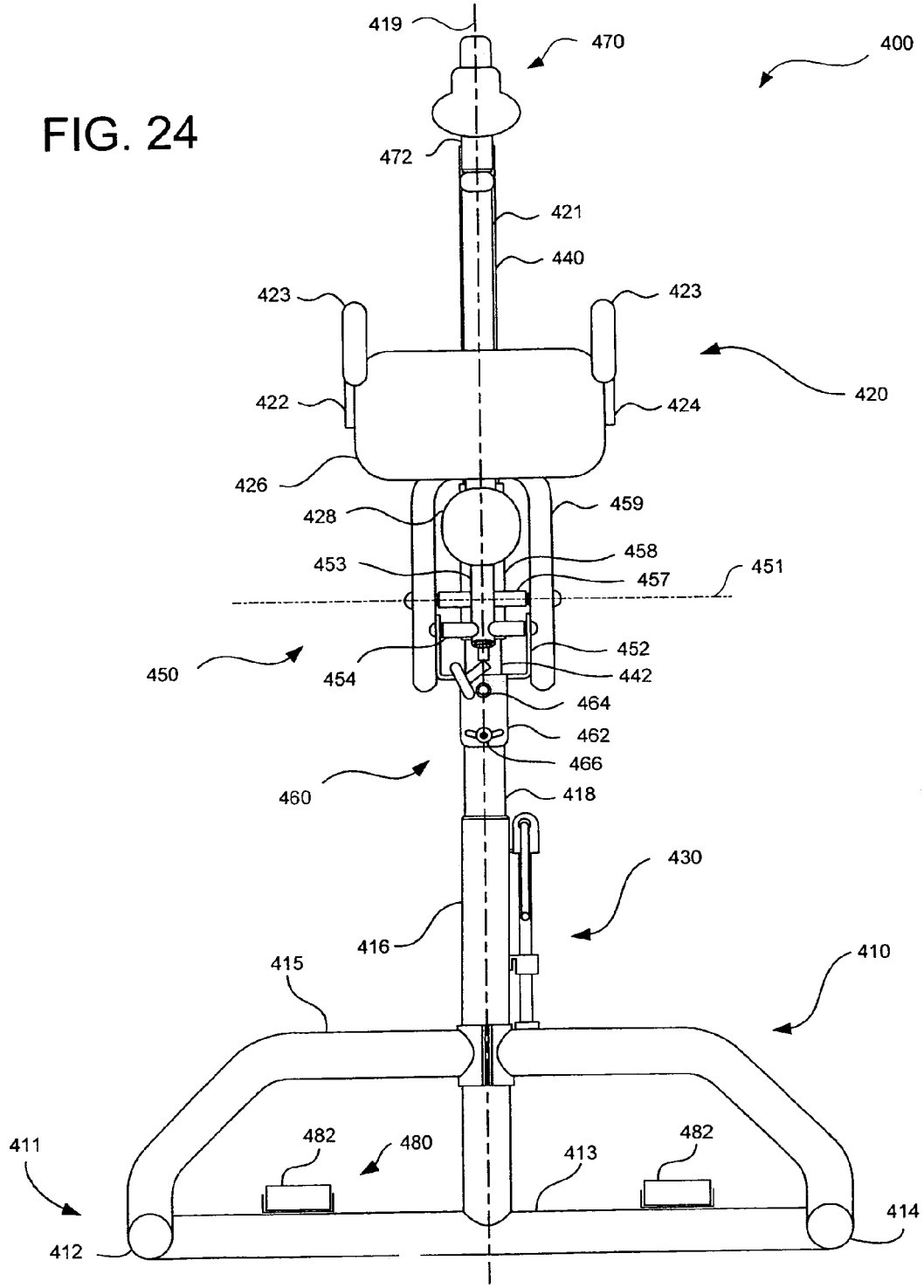
FIG. 24 is a front view of the exercise device of FIG. 22.

With reference to FIGS. 22-24, another embodiment of the golf exercise device according to the invention will now be discussed. In this embodiment, a yoke similar to that of the previous embodiment is rotated via a pivot suspended above the user. This configuration allows the yoke's axis of rotation to be aligned or nearly aligned with the axis of the user's spine.

FIG. 22 illustrates a golf exercise device 400 having a support structure 410 that supports a pivotable support arm 440, a pivot mechanism 450, 460, a yoke 420, and a resistance mechanism 470. The exercise device 400 may be configured so that a user may grasp the yoke 420 and rotate the yoke through an arc simulating a preferred golf swing. In order to ensure that the arc properly matches the golfer's swing, the exercise device 400 has multiple rotational and translational adjustment mechanisms that allow the device 400 to be tailored to the user's stature and swing characteristics. In particular, the yoke rotation axis 471 may be aligned or nearly aligned with an axis defined by a user's spine.

The exercise device 400 will now be discussed in more detail. The support arm 440 may have a straight lower support arm portion 442, a middle support arm portion 444, and a straight upper support arm portion 446. In some embodiments, the lower, middle, and upper support arm portions 442, 444, 446 may be collinear. In the illustrated embodiment, the lower support arm portion 442 extends upward along a lower support arm axis 443, the middle support arm portion 444 curves to extend upward and forward, and the upper support arm portion 446 extends forward along an upper support arm axis 447 that is perpendicular to the lower support arm axis 442. In FIG. 23, the support arm 440 is shown in a vertical position, in which the lower support arm axis 443 is parallel to the vertical axis 419 of the exercise device 400. A yoke attachment member 472, which may define a yoke rotation axis 471 substantially perpendicular to the upper support arm axis 447, may be fixedly attached to the forward end of the upper support arm portion 446. The yoke 420 may be rotatably attached to the yoke attachment member 472 by a yoke support arm 421, so that the yoke 420 rotates about the yoke rotation axis 471. As will be discussed in more detail below, the resistance mechanism 470 may be attached to the yoke attachment member 472 so as to provide resistance to the free rotation of the yoke 420.

The upper support arm 446 is configured to position the yoke support arm 421 so that it is above a user who has positioned himself to use the exercise device 400 and is in approximate alignment with the user's spine. As described above, the yoke support arm 421 may be attached to the yoke attachment member 472. The yoke support arm 421 may extend backward, parallel to the upper support arm axis 447, and then curve downward, extending straight along an yoke support arm axis 429 that may be parallel to the lower support arm axis 443. As shown in the illustrated embodiment, the yoke 420 may have left and right side members 422, 424 connected at their proximal end to the yoke support arm 421. Handgrips 423 may be attached to the distal ends of the side members 422, 424 to facilitate the user's grip on the yoke 420.

The yoke 420 may include one or more pads that allow the user to brace himself against the yoke 420 while using the exercise device 400. As shown in the illustrated embodiment, a first pad 426 may be positioned on the yoke 420 so that it may be engaged by a user's upper back or shoulder blades. A second pad 428 may be positioned below the first pad 426 to provide a brace for the user's spine.

Additionally, the yoke 420 may comprise an optional yoke adjustment mechanism 425. The yoke adjustment mechanism 425 may allow the user to further adjust the yoke to his needs. For example, the yoke adjustment mechanism 425 may be configured to allow the user to adjust the left and right side members 422, 424 and/or one or both of the pads 426, 428 up or down relative to the yoke support arm 421. Additionally, the yoke adjustment mechanism 425 may be configured to allow the user to adjust the distance between one or both of the pads 426, 428 and the yoke support arm 421. For example, in order to better align the spine of a smaller user with the yoke rotation axis 471, the pads 426, 428 may need to moved forward relative to the yoke support arm 421, whereas a larger use may require the pads 426, 428 to be positioned up against the yoke support arm 421 as illustrated in FIG. 23.

The support arm 440 may be supported and held in place by a longitudinal pivot control mechanism 450 and a lateral pivot control mechanism 460, which serve to connect the support arm 440 to the support structure 410. In the illustrated embodiment, the support structure 410 comprises a base 411, a primary support column 416, a lateral brace 415, and a secondary support column 418. The base 411 may comprise left, right, and rear base members 412, 414, and 413, respectively, that combine to provide a stable platform for the exercise device 400. The primary support column 416 may be connected to and extend forward and upward from the rear base member 413. The lateral brace 415 may connect the left and right base members 412, 414 and the primary support column 416. The portion of the primary support column 416 extending upward from the lateral brace 415 is substantially vertical and defines a vertical axis 419.

The primary support column 416 may be formed as a tube member that is adapted to slidably receive at least a portion of the secondary support column 418. When inserted into the primary support column 416, the exposed length of the secondary support column 418 may be adjusted by translating the secondary support column 418 up or down. This effectively adjusts the overall height of the exercise device 400. In some embodiments of the invention, a height adjustment mechanism 430 may translate the secondary support column 418 up or down and may optionally include a hand crank, as illustrated in FIGS. 23-24. The height adjustment mechanism 430 may also be adapted to lock the secondary support column 418 at a particular position.

It will be understood that the above-described support structure is one of many that could be used with the exercise device 400. Any structure that provides a solid base for the device and allows for free relative movement and rotation of the device components may be used. In addition, any means for adjusting the height of the base may be used.

The pivot mechanisms 450, 460 may be adapted to allow the user of the exercise device 400 to adjust the longitudinal angle (i.e., the amount of forward pitch from the vertical) and the lateral angle (i.e., the sideways tilt from the vertical). The longitudinal pivot control mechanism 450 may include a longitudinal pivot bracket 452 attached to the upper end of the secondary support column 418 by the lateral pivot control mechanism 460, which is described below. As shown in the illustrated embodiment, a U-shaped fork 459 may be mounted to the longitudinal pivot bracket 452, such that the U-shaped fork 459 is attached to each side of the bracket and extends upward and backward, surrounding the support arm attachment sleeve 458. The support arm attachment sleeve 458 may be rotatably attached to the inside of the U-shaped fork 459 by a support arm rotation shaft 457 defining a longitudinal rotation axis 451 about which the support arm attachment sleeve 458 may be rotated. The support arm adjustment sleeve 458 may be configured to slidably receive the lower support arm portion 442. When the lower support arm portion 442 is inserted into the support arm adjustment sleeve 458, the height of the yoke 420 relative to the top of the secondary support column 418 may be adjusted up or down by raising or lowering the support arm 440. This not only adjusts the overall height of the exercise device 400, but also adjusts the relative positions of the three main axes 451, 461, 471 of the exercise device 400. Once the desired position is established, the support arm may be locked into position, such as by way of example only a knobbed locking screw (not shown).

Figure 25:
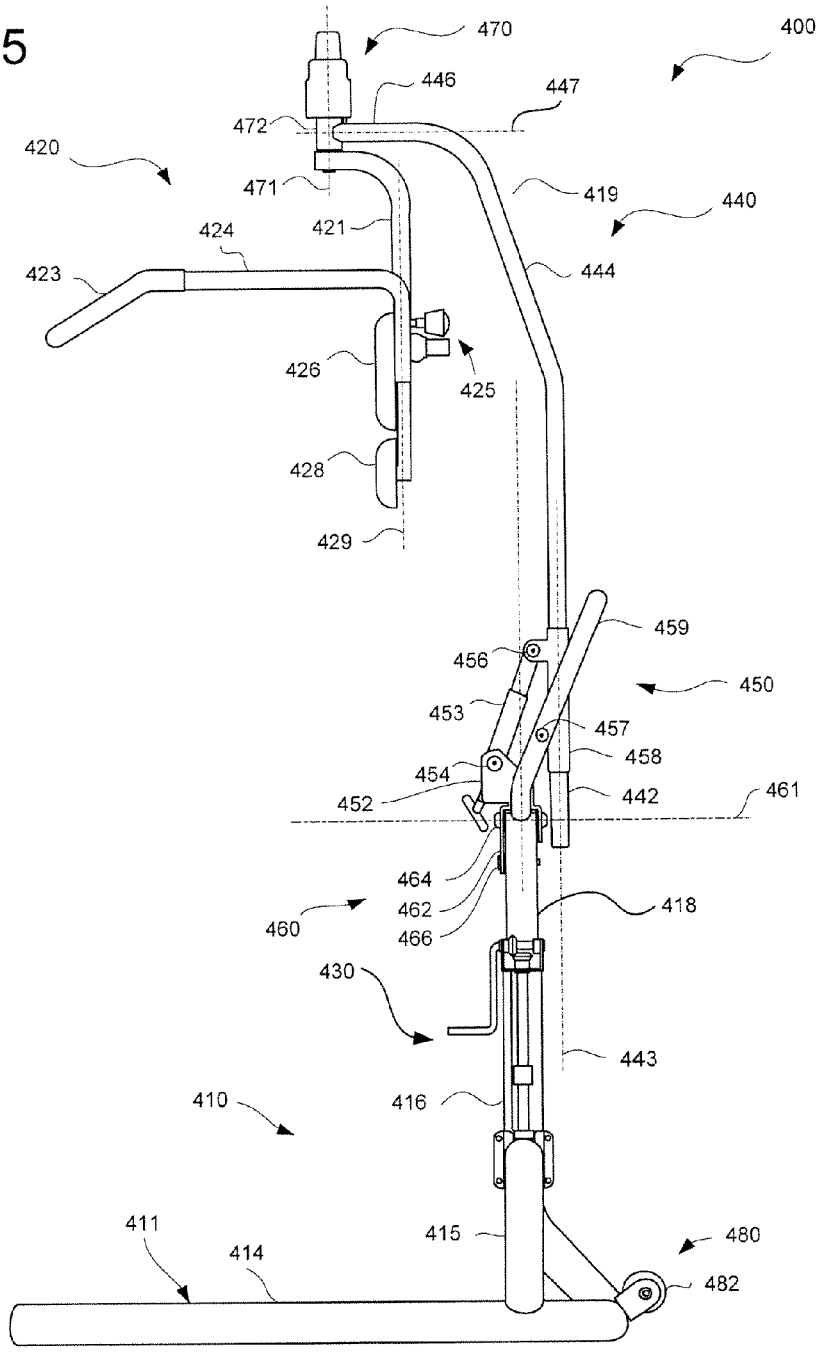
FIG. 25 is a right side view of the exercise device of FIG. 22 illustrating a height adjustment feature of the device.

A comparison of FIGS. 23 and 25 illustrates the effect of adjusting the position of the support arm 440 in the support arm adjustment sleeve 458. FIG. 23 shows the support arm 440 in a lowered position relative to the support arm adjustment sleeve 458. FIG. 25 shows the support arm 440 in a raised position, which has the effect of moving the yoke attachment member 472 upward relative to the longitudinal and lateral rotation axes 451, 461.

The longitudinal pivot control mechanism 450 may include a longitudinal rotation adjustment mechanism 453 in order to rotate the support arm 440 about the longitudinal rotation axis 451 and to hold the support arm 440 at a particular rotational angle. One end of the longitudinal rotation adjustment mechanism 453 may be attached at one end to the longitudinal pivot bracket 452 at a longitudinal bracket attachment point 454 and may be attached at another end to the support arm adjustment sleeve 458 at a sleeve attachment point 456. As shown in the illustrative embodiment, the longitudinal rotation adjustment mechanism 453 may be a screw-type device, such that twisting a handle may raise or lower the support arm 440. The longitudinal rotation adjustment mechanism 453 may also comprise other devices known in the art for rotating and holding the support arm 440 at a particular rotational angle.

Figure 26:
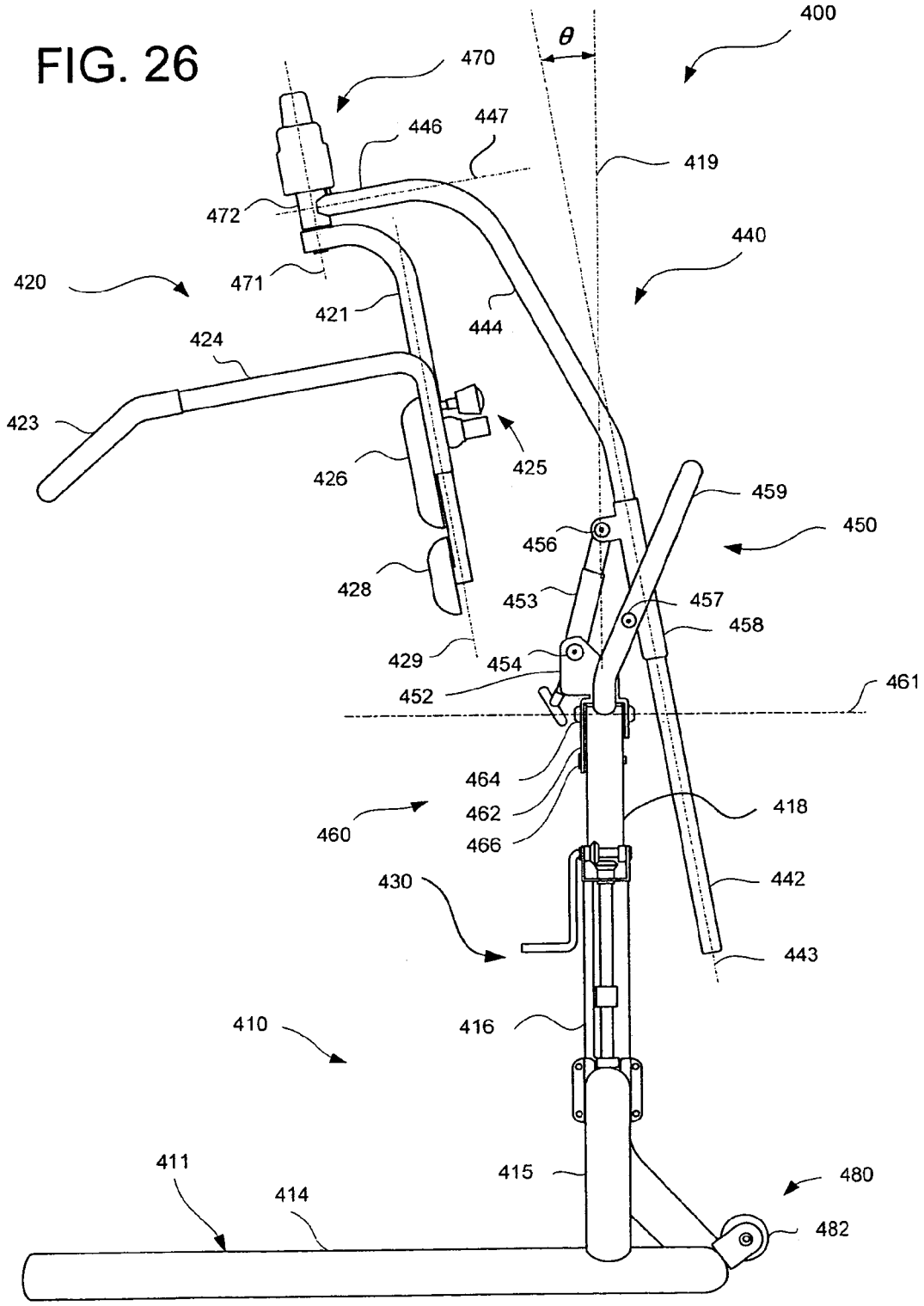
FIG. 26 is a right side view of the exercise device of FIG. 22 illustrating a forward pitch angle in a longitudinal plane of the device.

FIGS. 23 and 26 illustrate the establishment of a forward pitch angle by rotation of the support arm 440 about the longitudinal rotation axis 451. In the vertical position shown in FIG. 23, the lower support arm axis 443 is parallel with the vertical axis 419. When rotated forward as shown in FIG. 26, the lower support arm axis 443 establishes a pitch angle θ. As previously discussed, this angle may be set at the angle formed by a user's spine when the user addresses a golf ball. This assures that the yoke rotation axis 471 will be substantially collinear with the user's spine when the user adopts this position user the use of the exercise device 400.

As noted above, the longitudinal pivot bracket 452 may be fixedly attached to the lateral pivot bracket 462 of the lateral pivot mechanism 460. The lateral pivot bracket 462 may be pivotably attached to the secondary support column 418 at a lateral bracket attachment point 464 defining a lateral rotation axis 461. This allows the yoke 420, the support arm 440, the support arm adjustment sleeve 458, and the longitudinal pivot control mechanism 450 to rotate as a unit about the lateral rotation axis 461. Once a desired tilt angle has been established, the lateral pivot bracket 462 may be locked in place, for example by using a lateral locking screw 466, a locking knob (not shown), etc.

Figure 27:
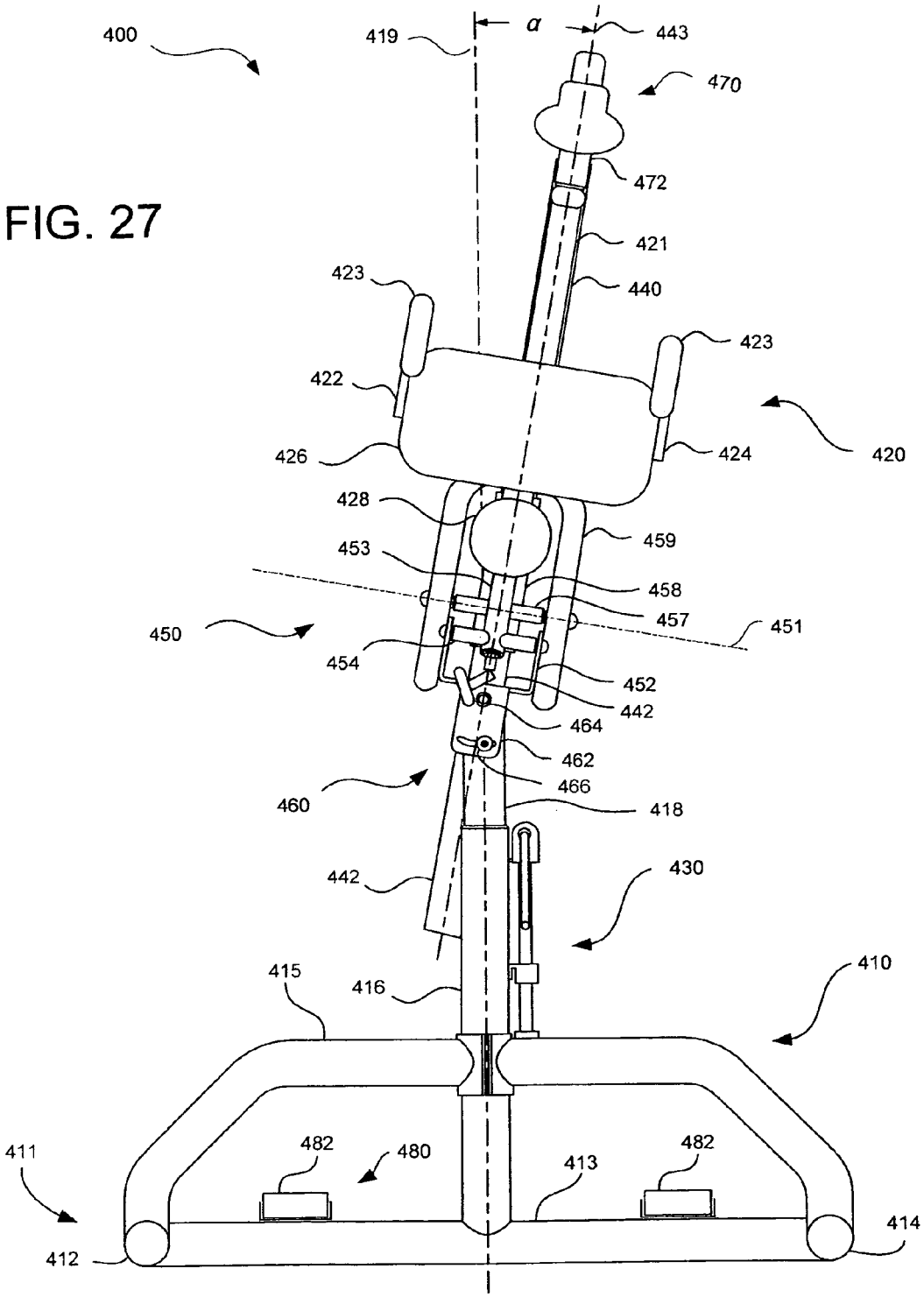
FIG. 27 is a front view of the exercise device of FIG. 22 illustrating a lateral adjustment in a lateral plane of the device.

FIGS. 24 and 27 illustrate the establishment of a sideways tilt angle by rotation of the lateral pivot bracket 462 about the lateral rotation axis 461. FIG. 24 shows the exercise device 400 in its fully vertical configuration. As previously noted, when the support arm 440 is in its vertical position, the lower support arm axis 443 is parallel with the vertical axis 419. When the lateral pivot bracket 462 is pivoted about the lateral rotation axis 461 as shown in FIG. 27, the lower support arm axis 443 establishes a lateral tilt angle α. As previously discussed, this angle is ideally set at the amount to which a user tilts his upper body left or right when the user addresses a golf ball. Typically, a right-handed golfer will have a tilt toward the left (from the user's perspective when standing facing away from the machine) as shown in FIG. 27.

In order to use the exercise device 400 in the preferred manner, a user first adjusts the forward pitch angle θ and the lateral tilt angle α to his stature and the desired swing profile. The user then places his upper back against the pad 426 of the yoke 420 and grasps the handgrips 423. If properly configured, the yoke rotation axis 471 should be substantially collinear with the user's spine. The user then rotates the yoke 420 about the yoke rotation axis 471 to simulate the rotation of a golf swing.

As noted above, the exercise device 400 comprises a resistance mechanism 470 that serves to oppose the rotation of the yoke 420 with a pre-selected degree of resistance. The resistance mechanism may incorporate virtually any form of mechanism that allows for adjustable resistance to rotation of a tube or shaft. In some embodiments of the invention, the resistance mechanism may comprise mechanical cone resisters, which may be configured to provide resistance in both directions, forward and back, right or left handed. This form of resistance mechanism can be adjusted to an almost infinite variety of resistance by a simple turn of a resistance knob.

It will be understood that in some embodiments, the resistance mechanism 470 may incorporate weight-based resistances similar to those described for exercise device 1 of FIGS. 1-12. In such embodiments, a flywheel or pulley wheel may be directly or indirectly connected to the yoke attachment member 472 so that it rotates about the yoke rotation axis 471 with the yoke 420. The flywheel or pulley wheel may be shaped so as to provide a constant resistance or a variable resistance depending on the yoke rotation angle.

In other embodiments, hydraulic, electromechanical, elastic or other types of variable resistance may be applied to the yoke attachment member 472 to resist rotation of the yoke 420. Alternatively, such mechanical resistance devices may be connected to the yoke 420 itself which would then act as a moment arm to counter its own rotation.

The exercise device 400 may be constructed in a relatively compact form of lightweight materials. The device 400 may also be equipped with wheels to facilitate its portability. In the illustrated embodiment, the exercise device 400 includes two wheel assemblies 480 attached to the rear base member 412. These wheel assemblies 480 are positioned so that the wheels 482 do not support any of the weight of the device 400 when in its upright, operating position. When the support structure 410 is tilted rearward, however, the weight of the device 400 is placed on the wheels 482 so that the device can be moved in a similar manner to a handcart.

The golf exercise devices according to various embodiments of the invention may be adjusted for use by a user that is seated on a stool or some other resting device (not shown) for supporting the weight of the user's body while the upper torso and its associated muscles remain free to rotate during performance of the golf swing. This would allow isolation of the trunk and shoulder muscles because the upper thigh muscles would be inactive in that position.

The golf exercise devices of the invention may be coupled with a conventional video recording/monitoring system as a training aid and/or to provide the user real-time capability to visualize his/her swing. In addition, the golf exercise devices of the invention may include analog, digital or wireless recording/monitoring equipment to keep track of weight used during training, as well as range of motion sensors for monitoring progress over time. These recording devices could also be used in conjunction with one or more conventional pressure or weight sensors under one or both feet to enable the user to monitor and visually detect his/her weight distribution on each leg during all phases of the golf swing. This provides another valuable training aid. Moreover, the yoke may be modified by addition of a golf club or the handle of a simulated golf club to provide the user with a more realistic feel during the training.

Many embodiments and adaptations of the present invention other than those herein described, will be apparent to those skilled in the art by the foregoing description thereof, without departing from the substance or scope of the invention. While the present invention has been described herein in detail in relation to its exemplary embodiments, it is to be understood that this disclosure is only illustrative and exemplary of the present invention. Accordingly, the foregoing disclosure is not intended to limit the scope of the present invention which is defined by the claims and their equivalents.

What is claimed is:

1. An exercise device comprising:

a support structure comprising a support member;

a support arm having an upper support arm portion and a lower support arm portion, the support arm being mounted to the support member by a pivot assembly comprising a longitudinal pivot control mechanism and a lateral pivot control mechanism, the longitudinal pivot control mechanism being configured to allow the support arm to be selectively positioned at a first angular orientation in a longitudinal plane and the lateral pivot control mechanism being configured to allow the support arm to be selectively positioned at a second angular orientation in a lateral plane orthogonal to the longitudinal plane; and a yoke pivotably attached to the upper support arm by a yoke attachment member so that the yoke is constrained to rotate about a yoke rotation axis, the yoke being configured for engagement by a user in an exercise orientation and for selective rotation about the yoke rotation axis by the user, wherein the support arm is attached to the pivot assembly by a support arm adjustment sleeve adapted for slidably receiving at least a portion of the support arm, thereby allowing adjustment of a distance between the pivot assembly and the yoke attachment member, and wherein the longitudinal pivot control mechanism includes a pivot arm member having a first end pivotably attached to the support arm adjustment sleeve and a second end pivotably attached to the lateral pivot control mechanism, the pivot arm member having an adjustable length through which the first angular orientation can be established and maintained.

2. An exercise device according to claim 1, wherein the first and second angular orientations are selectable so that the yoke rotation axis is substantially collinear with an axis defined by the spine of the user when the user is in the exercise orientation.

3. An exercise device according to claim 1, wherein the first and second angular orientations are selectable so that the yoke rotation axis is substantially parallel to an axis defined by the spine of the user when the user is in the exercise orientation.

4. An exercise device according to claim 1, wherein the longitudinal pivot control mechanism includes a first locking device for locking the support arm in the first angular orientation and the lateral pivot control mechanism includes a second locking device for locking the support arm in the second angular orientation.

5. An exercise device according to claim 1, wherein the support structure includes means for adjusting a height of the pivot assembly.

6. An exercise device according to claim 1, wherein the longitudinal pivot control mechanism includes means for selectively locking the adjustable length of the pivot arm member.

7. An exercise device according to claim 1, wherein the support arm comprises an upper support arm portion defining an upper support arm axis and a lower support arm portion defining a lower support arm axis.

8. An exercise device according to claim 7, wherein the yoke rotation axis is collinear with the upper support arm axis.

9. An exercise device according to claim 7, wherein the upper support arm member axis and the lower support arm member axis are collinear.

10. An exercise device according to claim 1, wherein the support member comprises a vertical support column attached to a base.

11. An exercise device according to claim 1, further comprising:

a resistance mechanism coupled to the yoke attachment member, the resistance mechanism being adapted for selectively providing resistance to rotation of the yoke about the yoke rotation axis.

12. An exercise device according to claim 11, wherein the resistance mechanism includes means for adjusting the amount of resistance.

13. An exercise device comprising:

a yoke configured for engagement by a user in an exercise orientation and for selective rotation about a yoke rotation axis by the user;

a support structure comprising a support member;

a support arm mounted to the support member by a pivot assembly having means for selectively positioning the support arm at a first angular orientation in a longitudinal plane and means for selectively positioning the support arm at a second angular orientation in a lateral plane orthogonal to the longitudinal plane; and means for rotatably attaching the yoke to the support arm so that the yoke is constrained to rotate about the yoke rotation axis, wherein the first and second angular orientations are selectable so as to establish a desired yoke rotation axis orientation relative to an axis defined by the spine of the user when the user is in the exercise orientation, wherein the support arm is attached to the pivot assembly by a support arm adjustment sleeve adapted for slidably receiving at least a portion of the support arm, thereby allowing adjustment of a distance between the pivot assembly and the yoke attachment member, and wherein the means for selectively positioning the support arm at a first angular orientation in a longitudinal plane include a pivot arm member having a first end pivotably attached to the support arm adjustment sleeve and a second end pivotably attached to the means for selectively positioning the support arm at a second angular orientation, the pivot arm member having an adjustable length through which the first angular position orientation can be established and maintained.

14. An exercise device according to claim 13, wherein the first and second angular orientations are selectable so that the yoke rotation axis is substantially collinear with the axis defined by the spine of the user when the user is in the exercise orientation.

15. An exercise device according to claim 13, wherein the first and second angular orientations are selectable so that the yoke rotation axis is substantially parallel to an axis defined by the spine of the user when the user is in the exercise orientation.

16. An exercise device according to claim 13, wherein the pivot assembly includes at least one of the set consisting of means for locking the support arm in the first angular orientation and means for locking the support arm in the second angular orientation.

17. An exercise device according to claim 13, further comprising:

means for adjusting a resistance to rotation of the yoke about the yoke rotation axis.

* * * * *

UNITED STATES PATENT AND TRADEMARK OFFICE

CERTIFICATE OF CORRECTION

PATENT NO. : 7,641,596 B2
APPLICATION NO. : 11/592559
DATED : January 5, 2010
INVENTOR(S) : Chester H. Sharps It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 310 days.

Signed and Sealed this

Sixteenth Day of November, 2010

David J. Kappos

David J. Kappos
*Director of the United States Patent and Trademark Office*